US007827969B2

(12) United States Patent
Yamamoto et al.

(10) Patent No.: US 7,827,969 B2
(45) Date of Patent: Nov. 9, 2010

(54) FUEL SUPPLY DEVICE

(75) Inventors: Shuji Yamamoto, Obu (JP); Tetsuji Inoue, Obu (JP)

(73) Assignee: Aisan Kogyo Kabushiki Kaisha, Obu-shi, Aichi-ken (JP)

( * ) Notice: Subject to any disclaimer, the term of this patent is extended or adjusted under 35 U.S.C. 154(b) by 151 days.

(21) Appl. No.: 11/814,693

(22) PCT Filed: Jan. 23, 2006

(86) PCT No.: PCT/JP2006/300955

§ 371 (c)(1),
(2), (4) Date: Nov. 24, 2008

(87) PCT Pub. No.: WO2006/080272

PCT Pub. Date: Aug. 3, 2006

(65) Prior Publication Data

US 2009/0183715 A1 Jul. 23, 2009

(30) Foreign Application Priority Data

Jan. 27, 2005 (JP) ..... 2005-019483
Oct. 12, 2005 (JP) ..... 2005-298204

(51) Int. Cl.
*F02M 37/04* (2006.01)

(52) U.S. Cl. ..... 123/509

(58) Field of Classification Search ..... 123/509
See application file for complete search history.

(56) References Cited

U.S. PATENT DOCUMENTS 5,038,741 A * 8/1991 Tuckey ..... 123/509
5,075,822 A * 12/1991 Baumler et al. ..... 361/710
5,454,697 A * 10/1995 Nakanishi ..... 417/423.3
5,593,287 A * 1/1997 Sadakata et al. ..... 417/366
5,613,844 A * 3/1997 Tuckey et al. ..... 417/366
5,649,514 A 7/1997 Okada et al.
5,778,926 A 7/1998 Tanaka et al.
5,782,223 A 7/1998 Yamashita et al.
5,900,148 A 5/1999 Izutani et al.
6,132,184 A * 10/2000 Robertson et al. ..... 417/410.3
6,302,144 B1 10/2001 Graham et al.

(Continued)

FOREIGN PATENT DOCUMENTS

DE 19 581549 4/1997

(Continued)

*Primary Examiner*—Thomas N Moulis
(74) *Attorney, Agent, or Firm*—Dennison, Schultz & MacDonald

(57) ABSTRACT

The present invention provides a fuel supply device that can suppress the excessive heating of a fuel supplied from a fuel pump into an internal combustion engine even if a control module is cooled. The fuel supply device (1) comprises a set plate (10) attached to a mounting hole (34*a*) of a fuel tank (34), an electric fuel pump (30) attached to an inner surface of the set plate (10), a control module (14) attached to an outer surface of the set plate (10), the control module driving the fuel pump (30) using electric power supplied from the exterior, and a heat radiating member (32) for radiating heat generated in the control module. One end of the heat radiating member (32) is thermally connected to the control module (14), and the other end of the heat radiating member (32) protrudes downward from the inner surface of the set plate (10).

18 Claims, 42 Drawing Sheets

U.S. PATENT DOCUMENTS

| | | | | |
|---|---|---|---|---|
| 6,600,653 | B2 * | 7/2003 | Koike et al. | 361/704 |
| 6,745,823 | B2 * | 6/2004 | Brost | 165/80.4 |
| 6,783,336 | B2 * | 8/2004 | Kempfer et al. | 417/423.1 |
| 6,886,542 | B2 * | 5/2005 | Yamada et al. | 123/509 |
| 7,055,505 | B2 * | 6/2006 | Washeleski et al. | 123/519 |
| 7,086,493 | B2 * | 8/2006 | Knight | 180/274 |
| 7,106,593 | B2 * | 9/2006 | Stabile et al. | 361/707 |
| 7,314,040 | B2 * | 1/2008 | Yagi et al. | 123/509 |
| 7,458,365 | B2 * | 12/2008 | Hazama | 123/509 |
| 7,497,207 | B2 * | 3/2009 | Lahn et al. | 123/497 |
| 7,497,208 | B2 * | 3/2009 | Satoh et al. | 123/509 |
| 2004/0177886 | A1 | 9/2004 | Nagata et al. | |
| 2005/0100461 | A1 * | 5/2005 | Izutani et al. | 417/423.8 |
| 2007/0253845 | A1 * | 11/2007 | Suzuki | 417/423.8 |

FOREIGN PATENT DOCUMENTS

| | | |
|---|---|---|
| JP | 62 35088 | 2/1987 |
| JP | 2 19646 | 1/1990 |
| JP | 6 043834 | 6/1994 |
| JP | 06 280707 | 10/1994 |
| JP | 8 226357 | 9/1995 |
| JP | 08 177668 | 7/1996 |
| JP | 2 666387 | 1/1997 |
| JP | 2001 249011 | 9/2000 |
| JP | 2001 099029 | 4/2001 |
| JP | 2001 214826 | 8/2001 |
| JP | 2002 303217 | 10/2002 |
| JP | 2004 278355 | 10/2004 |
| JP | 2005 155602 | 6/2005 |

* cited by examiner

FUEL SUPPLY DEVICE

TECHNICAL FIELD

The present invention relates to a fuel supply device for feeding fuel to an internal combustion engine (for example, the engine of a motor vehicle). Specifically, the present invention relates to a cooling structure for a control module that controls the fuel supply device.

BACKGROUND ART

Fuel supply devices provided with a control module that controls a fuel pump have become mainstream in recent years. Since this type of control module is usually provided with a heat generating electronic device such as a power transistor or the like, cooling the control module has become a significant problem. A cooling structure for cooling the control module is set forth in Japanese Laid-open Patent Publication No. 2001-99029.

This fuel supply device comprises a set plate that covers a mounting hole of a fuel tank. A bracket is formed on a lower surface of the set plate (an inner surface of the fuel tank). A fuel pump is attached to the bracket. A circuit case is formed on an upper surface of the set plate (an outer surface of the fuel tank). A control module is housed within the circuit case. The set plate comprises a heat radiating plate made from metal, and a feeding pipe that passes through the heat radiating plate. A bottom surface of the control module housed in the circuit case makes contact with an upper surface of the heat radiating plate. A discharging hole of a fuel pump is connected with the feeding pipe. When the fuel pump of the fuel supply device is driven, the fuel within the fuel tank passes along the feeding pipe and is discharged to the exterior of the fuel tank. Heat generated in the control module is transmitted via the heat radiating plate to the fuel flowing along the feeding pipe. Heating of the control module is thus suppressed.

DISCLOSURE OF THE INVENTION

In the aforementioned fuel supply device, the control module is cooled by the fuel flowing along the feeding pipe (i.e. the fuel being fed from the fuel pump to the internal combustion engine). As a result, when there is a large amount of heating of the control module during high temperatures, such as in summer, there is excessive heating of the fuel fed to the internal combustion engine from the fuel pump, and air bubbles may form within the fuel. An inadequate amount of fuel is fed to the internal combustion engine when air bubbles are formed within the fuel, and consequently this affects the combustion control of the internal combustion engine.

It is an object of the present invention to provide a fuel supply device capable of suppressing the phenomenon where fuel that is being fed from a fuel pump to an internal combustion engine becomes excessively heated even though cooling of the control module is performed.

A fuel supply device of the present application is attached to a fuel tank, and discharges fuel stored in the fuel tank to the exterior of the fuel tank. This fuel supply device has a set plate attached to a mounting hole of a fuel tank, in which this set plate covers the mounting hole. An electric fuel pump is attached to an inner surface of the set plate (an inner surface of the fuel tank when the set plate is attached to the fuel tank). A control module is attached to an outer surface of the set plate (an outer surface of the fuel tank when the set plate is attached to the fuel tank), and the control module drives the fuel pump using electric power supplied from the exterior of the fuel tank.

A heat radiating member for radiating heat generated in the control module has one end thereof thermally connected to the control module, and the other end thereof protruding downward from the inner surface of the set plate. As a result, when the fuel supply device is attached to the fuel tank (i.e. when the set plate is attached to the mounting hole of the fuel tank), one end of the heat radiating member protrudes into the fuel tank, and is immersed in the fuel in the fuel tank. Consequently, the heat of the control module is transmitted to the entirety of the fuel in the fuel tank via the heat radiating member. It is consequently possible to suppress excessive heating of the fuel fed from the fuel pump to the internal combustion engine.

In this fuel supply device, the control module may have a heat generating electronic device. In this case, a heat radiating plate can be used as the heat radiating member, and the heat radiating plate may be bent at a central part. One side of the heat radiating plate from the bent part may protrude downward from the inner surface of the set plate, and a surface of the other side of the heat radiating plate from the bent part may be disposed on the outer surface of the set plate. It is preferred that the heat generating electronic device of the control module is disposed on the heat radiating plate disposed on the outer surface of the set plate.

With this type of configuration, it is possible by bending the heat radiating plate to immerse one end of the heat radiating plate in the fuel in the fuel tank while simultaneously thermally connecting the other end of the heat radiating plate with the heat generating electronic device of the control module. The heat generated in the control module is thus transmitted efficiently to the fuel in the fuel tank.

Further, in the case where the control module comprises a heat generating electronic device, a rod-shaped cooling rod may be used as the heat radiating member, and a plate-shaped head part may be formed on the cooling rod. A part of the cooling rod below the head part may protrude downward from the inner surface of the set plate, and the heat generating electronic device of the control module may be disposed on the head part of the cooling rod.

With this type of configuration, the heat of the control module can be transmitted efficiently to the fuel in the fuel tank via the cooling rod. Moreover, in the case where a cooling rod is used as the heat radiating member, it is preferred that cooling rods are utilized. In the case where cooling rods are utilized, it is preferred that the cooling rods make contact equally with the entirety of the control module.

The fuel supply device may be provided with a fuel filter for removing foreign matter from the fuel discharged from the fuel pump. The fuel filter may be attached to the inner surface of the set plate. In this case, it is preferred that when a circle having an extremely small radius and housing the fuel pump and the fuel filter has been drawn on a surface perpendicular to an axis of the fuel pump, a part of the heat radiating member protruding from the inner surface of the set plate is disposed within that circle. For example, the fuel filter is disposed along an outer circumference of the fuel pump, and the heat radiating member is positioned on a part of the outer circumference of the fuel pump where the fuel filter is not disposed. On a surface that is perpendicular to the axis of the fuel pump, the heat radiating member is disposed within a circle having the axis of the fuel pump as its center, and having as its radius the distance from this center to the outer circumference of the fuel filter. With this type of configuration it is possible to prevent the size of the fuel supply device from increasing in the radial direction, and space can thus be saved.

In the case where the heat radiating plate is used as the heat radiating member, the set plate and the heat radiating plate may be molded integrally by insert molding. In this case, it is preferred that a part of the heat radiating plate embedded within the set plate has a through hole formed therein, the through hole passing through the heat radiating plate in its direction of thickness. With this type of configuration, the set plate and the heat radiating plate can be joined firmly by filling an insert material (synthetic resin, or the like) into the through hole formed in the heat radiating plate.

Further, in the case of insert molding, it is possible to perform the insert molding with the heat radiating plate in an un-bent state, and the heat radiating plate can be bent after the insert molding has been performed. If the heat radiating plate is not bent, the insert molding can be performed with both ends of the heat radiating plate in a supported state.

Furthermore, the fuel supply device may further be provided with a pressure regulator for adjusting pressure of the fuel discharged from the fuel pump, and an ejection part for ejecting the fuel being returned by the pressure regulator to the fuel tank. The pressure regulator and the ejection part are provided on the inner surface of the set plate. In this case it is preferred that the position of the ejection part and the ejecting direction thereof is adjusted such that the fuel flows toward the heat radiating member.

With this type of configuration, the fuel returned by the pressure regulator can be used for cooling the heat radiating plate (i.e. the control module). As a result, the control module can be cooled effectively even when the amount of fuel in the fuel tank has been significantly reduced.

Furthermore, the fuel supply device may further be provided with a fuel circulating means to circulate fuel around the fuel tank, and a storage vessel for storing the fuel circulated by the fuel circulating means. In this case it is preferred that the heat radiating member is disposed within the storage vessel.

With this type of configuration, the fuel stored by the storage vessel can be used for cooling the heat radiating plate (i.e. the control module). As a result, the control module can be cooled effectively even when the amount of fuel in the fuel tank has been significantly reduced.

Furthermore, the fuel supply device may further be provided with a fuel circulating passage along which the fuel circulating within the fuel tank flows. The heat radiating member and the fuel circulating passage may be thermally connected.

With this type of configuration, the heat radiating plate is cooled by the fuel flowing along the fuel circulating passage, thus cooling the control module.

Furthermore, a second fuel supply device of the present application may comprise an electric fuel pump, a control module for driving the fuel pump using electric power supplied from the exterior, and a fuel circulating means for circulating fuel within the fuel tank. The fuel circulating means has a fuel discharge hole for discharging the circulating fuel into the fuel tank. The control module is cooled by the fuel discharged from the fuel discharge hole. Since the fuel circulated by the fuel circulating means is utilized to cool the control module, it is possible to suppress excessive heating of the fuel fed from the fuel pump to the internal combustion engine.

The second fuel supply device may further comprise a case for housing the control module. At least a part of the case is exposed within the fuel tank. It is preferred that fuel discharged from the fuel discharge hole is discharged at this exposed part.

With this type of configuration, the fuel discharged from the fuel discharge hole is discharged to the case, whereby the control module within the case is cooled by the discharged fuel. When the amount of heat generated in the control module increases and the case reaches a high temperature, the fuel discharged to the case vaporizes. As a result, the case (the control module) can be cooled effectively by the vapor latent heat of the fuel.

The second fuel supply device may further comprise a heat radiating plate thermally connected with the control module. At least a part of the heat radiating plate is exposed within the fuel tank. The fuel discharged from the fuel discharge hole may be discharged at this exposed part.

With this type of configuration, the contact area where the discharged fuel and the heat radiating plate make contact can be increased, and the control module can be cooled effectively.

It is preferred that in the second fuel supply device the fuel circulating means causes the fuel within the fuel tank to circulate around this fuel tank. Circulating the fuel around the fuel tank prevents the circulating fuel from being heated by the outside temperature, and the control module can consequently be cooled effectively.

The fuel circulating means may have, for example, a relief means for returning surplus fuel, pressurized by the fuel pump, back into the fuel tank. Alternatively, the fuel circulating means may have a means for sucking the fuel in the fuel tank using negative pressure generated by utilizing a part of the fuel pressurized by the fuel pump.

A third fuel supply device of the present application may comprise a set plate attached to a mounting hole of a fuel tank where this set plate covers the mounting hole, an electric fuel pump attached to the set plate, a control module for driving the fuel pump using electric power supplied from the exterior, and a case for housing the control module. The case is positioned substantially perpendicular with respect to the set plate. A part of the case protrudes into the fuel tank, whereby a part of the control module is also disposed on an inner side of the fuel tank. A heat generating electronic device of the control module is disposed on the inner side of the fuel tank, and other parts of the control module are disposed on an outer side of the fuel tank.

In this fuel supply device, the case (i.e. the control module) is positioned substantially perpendicular with respect to the set plate, and a part of the control module is disposed on the inner side of the fuel tank. As a result, a part of the case can be immersed in the fuel within the fuel tank, and the heat of the control module can be transmitted to the fuel within the fuel tank via the case. The heat of the control module can consequently be transmitted to the entirety of the fuel within the fuel tank, and it is possible to suppress excessive heating of the fuel fed to the internal combustion engine from the fuel pump.

Further, since the heat generating electronic device of the control module is disposed on the inner side of the fuel tank, the heat generated in the control module can be transmitted effectively to the fuel within the fuel tank.

Furthermore, a fourth fuel supply device of the present application may comprise an electric fuel pump, a control module for driving the fuel pump using electric power supplied from the exterior, a fuel circulating means for circulating fuel inside the fuel tank, and a storage vessel for storing the fuel circulated by the fuel circulating means. The control module is cooled by the fuel stored in the storage vessel.

In this fuel supply device, the fuel circulated by the fuel circulating means is stored in the storage vessel, and the control module is cooled using the stored fuel. It is possible to suppress excessive heating of the fuel fed to the internal combustion engine from the fuel pump by using the fuel circulated by the fuel circulating means to cool the control module. Further, since the control module is cooled using the fuel stored within the storage vessel, it is possible to cool the control module effectively even when the amount of fuel in the fuel tank has been significantly reduced.

BEST MODE FOR CARRYING OUT THE INVENTION

First Embodiment

Figure 1:
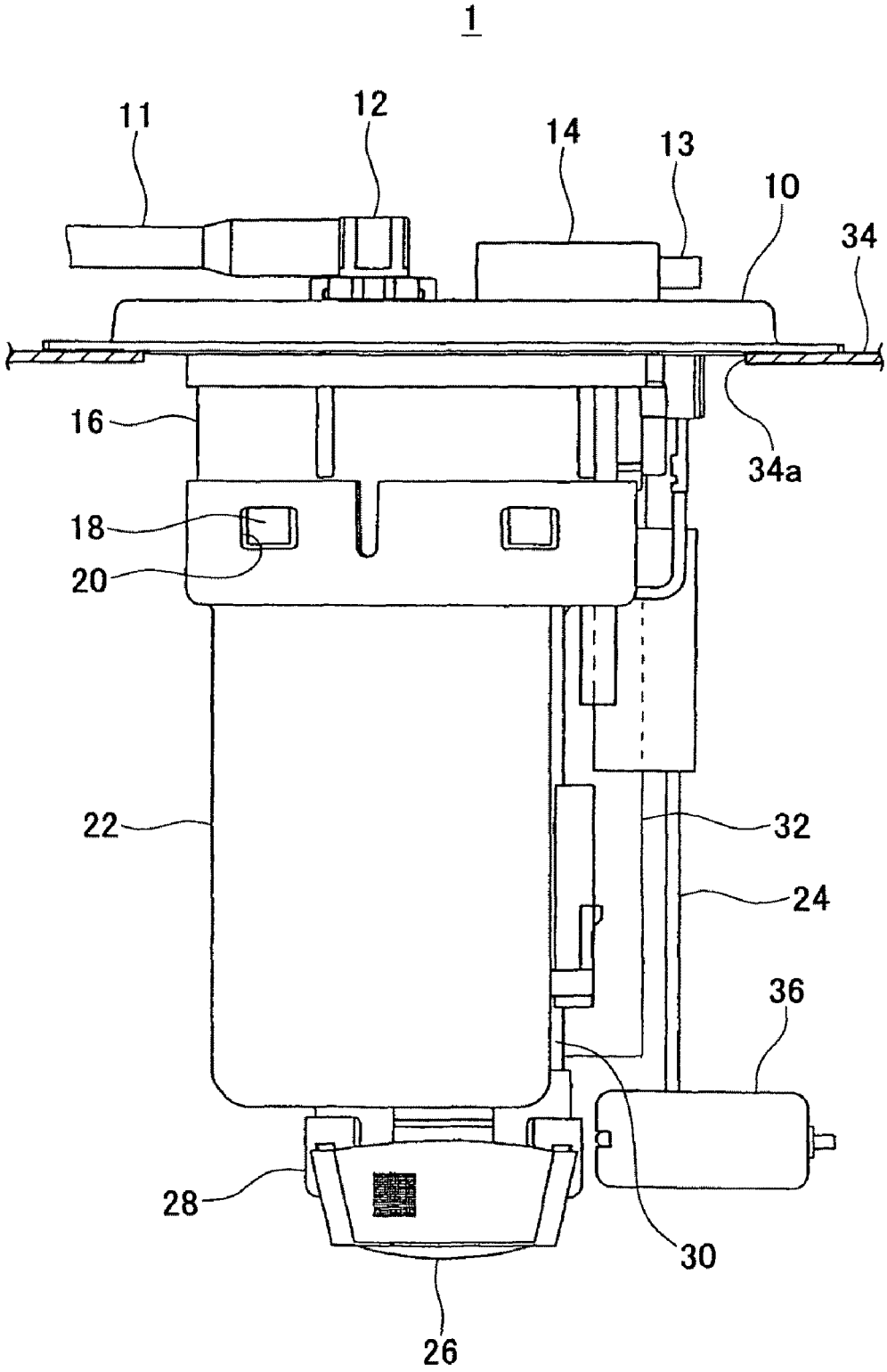
FIG. 1 is a front view of a fuel supply device of the present embodiment.
Figure 2:
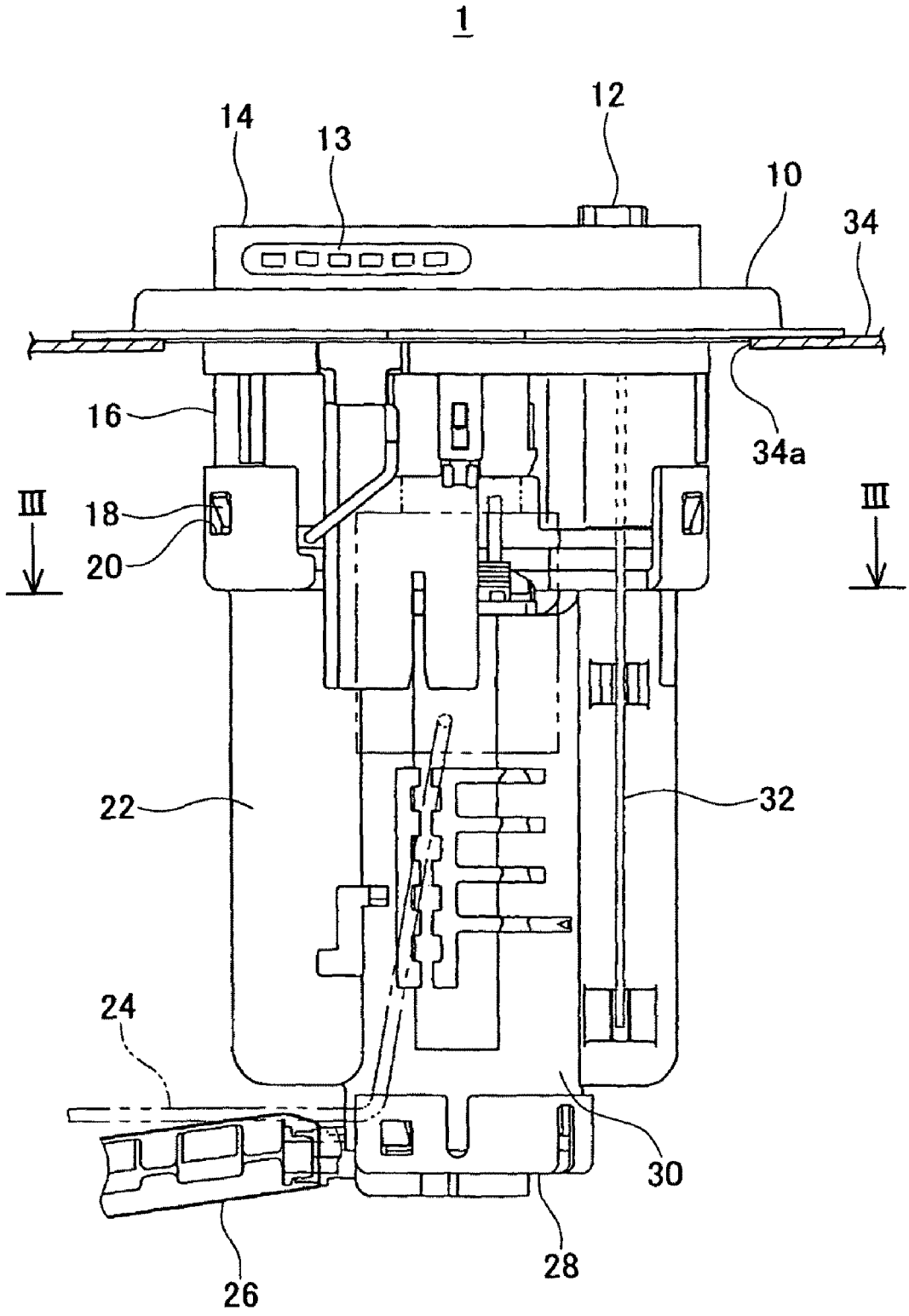
FIG. 2 is a right side view of the fuel supply device shown in FIG. 1.

A fuel supply device of a first embodiment of the present invention will be described below. First, the entire configuration of the fuel supply device will be described with reference to FIGS. 1 to 3. As shown in FIGS. 1 and 2, a fuel supply device 1 comprises a set plate 10 molded from insulating resin material. The set plate 10 is attached to a mounting hole 34*a* formed in an upper surface of a fuel tank 34. When the set plate 10 is attached to the mounting hole 34*a*, this mounting hole 34*a* is covered by the set plate 10. A circuit case 14 and a discharging pipe attaching part 12 are formed on an upper surface of the set plate 10 (an outer surface of the fuel tank 34).

The circuit case 14 houses a control module (described in detail later). A connector 13 is formed integrally with the circuit case 14. The control module housed in the circuit case 14 is connected to the connector 13. A power source such as a battery or the like, and a control unit for controlling an engine (neither of these are shown) are connected to a terminal of the connector 13.

A discharging pipe 11 is attached to the discharging pipe attaching part 12. The other end of the discharging pipe 11 is connected to an injector (not shown). Fuel discharged from the fuel supply device 1 to the discharging pipe 11 is fed to the engine via the injector.

A bracket part 16, a heat radiating plate 32, etc. extend downward within the fuel tank 34 from a lower surface of the set plate 10 (an inner surface of the fuel tank 34). The bracket part 16 is formed integrally with the set plate 10. A mounting portion 18 is formed at a lower end of the bracket part 16. The mounting portion 18 fits into a fitting hole 20 of a filter case 22. The set plate 10 and the filter case 22 are joined by fitting the mounting portion 18 into the fitting hole 20. As shown clearly in FIGS. 2 and 3, a fuel pump case 30 is joined with the filter case 22.

A fuel pump 31 (shown in FIG. 3) is housed within the fuel pump case 30. A suction filter 26 is attached by means of an attaching portion 28 to a fuel intake hole (not shown) at a lower end of the fuel pump (see FIGS. 1 and 2). The suction filter 26 removes comparatively large foreign matter from the fuel drawn into the fuel pump.

Figure 3:
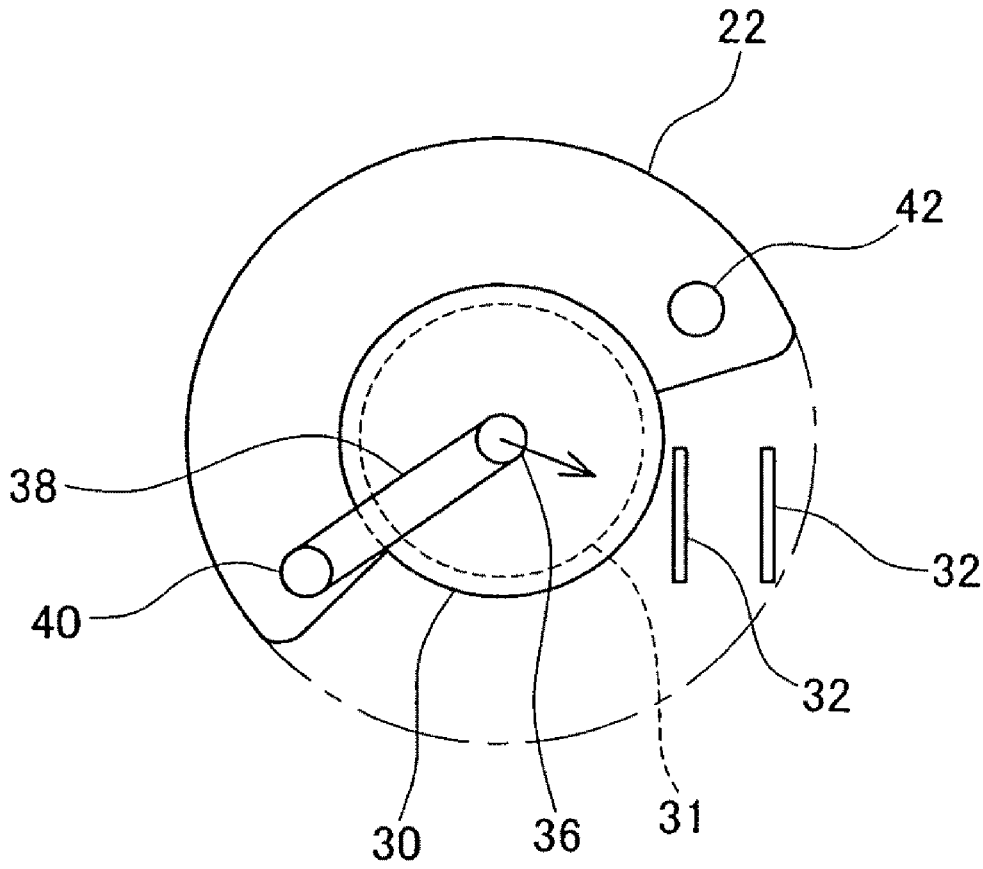
FIG. 3 is a cross-sectional view along the line III-III of FIG. 2.

As shown clearly in FIG. 3, one end of a connecting pipe 38 is attached via a pressure regulator 36 to a fuel discharge hole at an upper end of the fuel pump. The pressure regulator 36 adjusts the fuel pressure of fuel discharged from the fuel pump, and returns surplus fuel, of the fuel that was discharged from the fuel pump, back into the fuel tank 34. Further, the control module within the circuit case 14 is connected via a lead wire to an electric motor within the fuel pump.

As shown clearly in FIG. 3, the filter case 22 has an arc shape when viewed from the side of the set plate 10. The fuel pump case 30 is fitted into an inner side of the filter case 22. A fuel filter (not shown) is housed within the filter case 22. The fuel filter removes minute foreign matter from the fuel discharged from the fuel pump. A fuel inflow hole 40 and a fuel discharging hole 42 are formed in an upper surface of the filter case 22. The fuel inflow hole 40 is connected via the connecting pipe 38 to the fuel discharge hole of the fuel pump. The fuel discharging hole 42 is connected via a piping (not shown) to the discharging pipe attaching part 12 of the set plate 10.

The heat radiating plate 32 that extends downwards from the lower surface of the set plate 10 is formed of a metal material that has a high coefficient of thermal conductivity (e.g. aluminum, copper). A lower end of the heat radiating plate 32 extends to the vicinity of a lower end of the fuel supply device 1. An upper end of the heat radiating plate 32 passes through the set plate 10 and is located at an upper surface of the set plate 10. As will be described later, the control module makes contact with the upper end of the heat radiating plate 32.

As shown in FIG. 3, the fuel supply device 1 is provided with two heat radiating plates 32, 32. The heat radiating plates 32, 32 are disposed on the outer peripheral side of the fuel pump case 30 at the portion where the filter case 22 is not disposed. Specifically, the heat radiating plates 32, 32 are disposed on the outer peripheral side of the fuel pump case 30 in a fuel discharging direction in which the fuel returns to the fuel tank 34 from the pressure regulator 36 (the direction of the arrow in the figure). As a result, when the fuel pump is driven and the surplus fuel returns to the fuel tank 34 from the pressure regulator 36, the fuel is discharged (flies) toward the heat radiating plates 32, 32, and makes contact with the heat radiating plates 32, 32.

Further, in a surface that is perpendicular with respect to an axis of the fuel supply device 1 (i.e. a surface that is parallel to the set plate 10), the heat radiating plates 32, 32 are disposed within a circle (the circle shown by the dashed line in the figure), this circle has the center of the fuel supply device is its center and has as its radius the distance from this center to an outer circumference of the filter case (i.e. the fuel filter). It is thus possible to prevent the heat radiating plates 32, 32 from increasing the size of the fuel supply device 1 in the radial direction, and the fuel supply device 1 can consequently be made compact.

The fuel supply device 1 further comprises a level gauge. The level gauge comprises a float 36, an arm 24, and a sensor part (not shown). The sensor part is attached in such a way that it can be removed from the set plate 10. The float 36 moves up and down as the amount of fuel in the fuel tank 34 changes. When the float 36 moves up and down, the arm 24 swings and the angle thereof changes. The sensor part detects the change in the rotational angle of the arm, and thereby measures the amount of fuel within the fuel tank 34.

Figure 4:
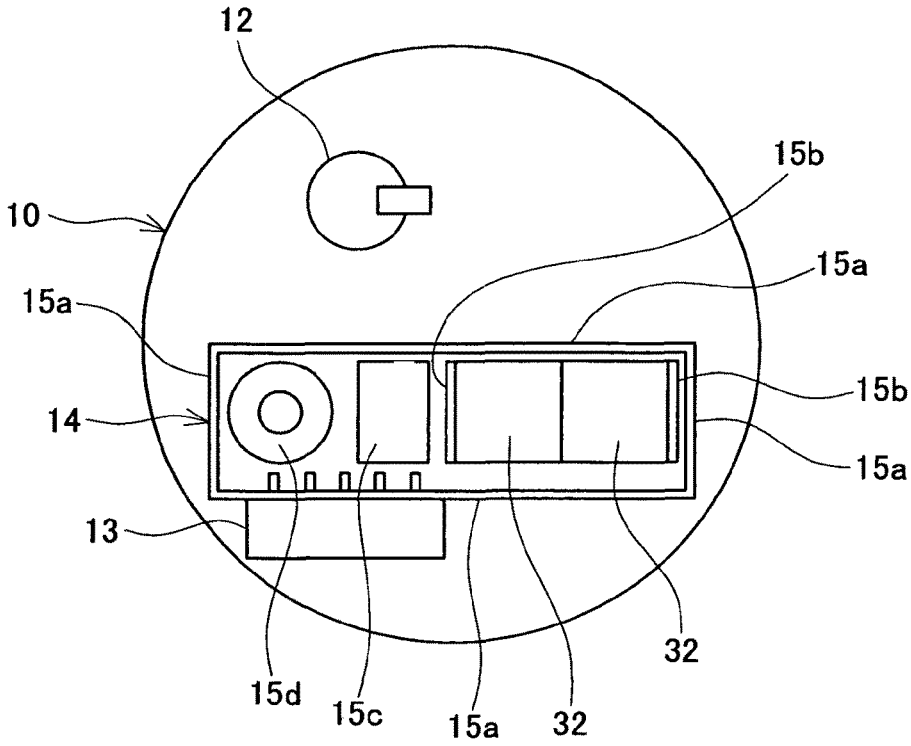
FIG. 4 is a plan view of a set plate 10 (prior to a control module being attached).
Figure 5:
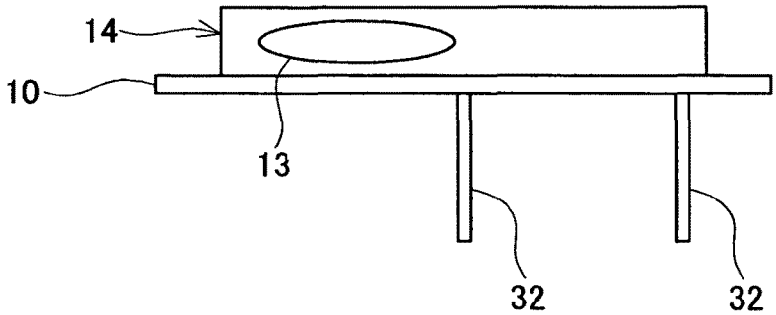
FIG. 5 is a front view of the set plate shown in FIG. 4.
Figure 6:
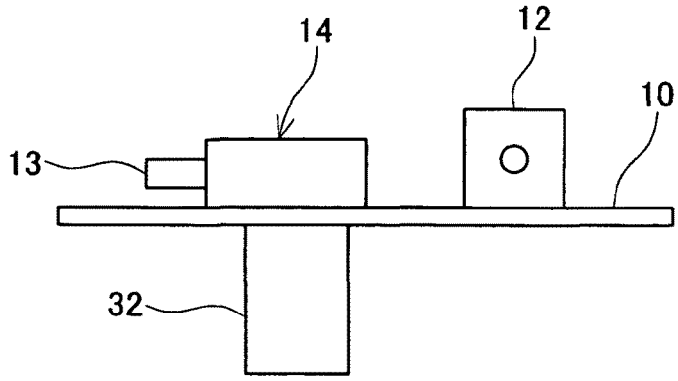
FIG. 6 is a right side view of the set plate shown in FIG. 4.

Next, the circuit case 14 formed on the upper surface of the set plate 10, and the control module mounted within the circuit case 14 will be described. As is clear from FIGS. 4 to 6, the circuit case 14 is formed in a rectangular parallelepiped shape by four wall parts 15*a* standing on the upper surface of the set plate 10. The connector 13 is formed integrally with one of the four wall parts 15*a*. An upper surface of the circuit case 14 is open. Upper end parts of the heat radiating plates 32 are disposed within the circuit case 14. That is, the heat radiating plates 32, 32 pass through the set plate 10, the upper ends thereof are located above the set plate 10, and the lower ends thereof are located below the set plate 10 (within the fuel tank 34) (see FIGS. 5 and 6).

The upper end parts of the heat radiating plates 32, 32 are each bent towards one another. One surface (a lower surface) of the upper end parts of the heat radiating plates 32 makes contact with the upper surface of the set plate 10. When the heat radiating plates 32 have been bent, upper ends thereof are adjacent and almost no space is present between the two. Holding portions 15*b*, 15*b* are formed near the bent parts of the heat radiating plates 32, 32. The holding portions 15*b*, 15*b* hold a heat sink (to be described later). A condenser holding part 15*c* and a coil holding part 15*d* are formed to the side of one of the holding portions 15*b*.

Figure 13:
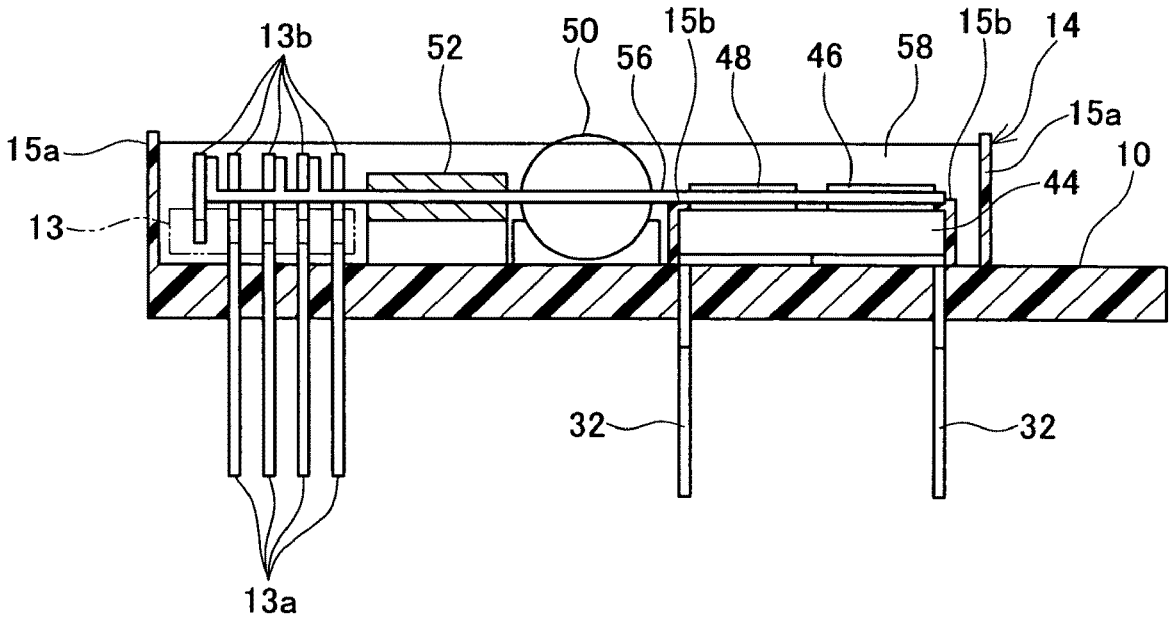
FIG. 13 describes the sequence for attaching the control module and the heat radiating plate to the circuit case.
Figure 14:
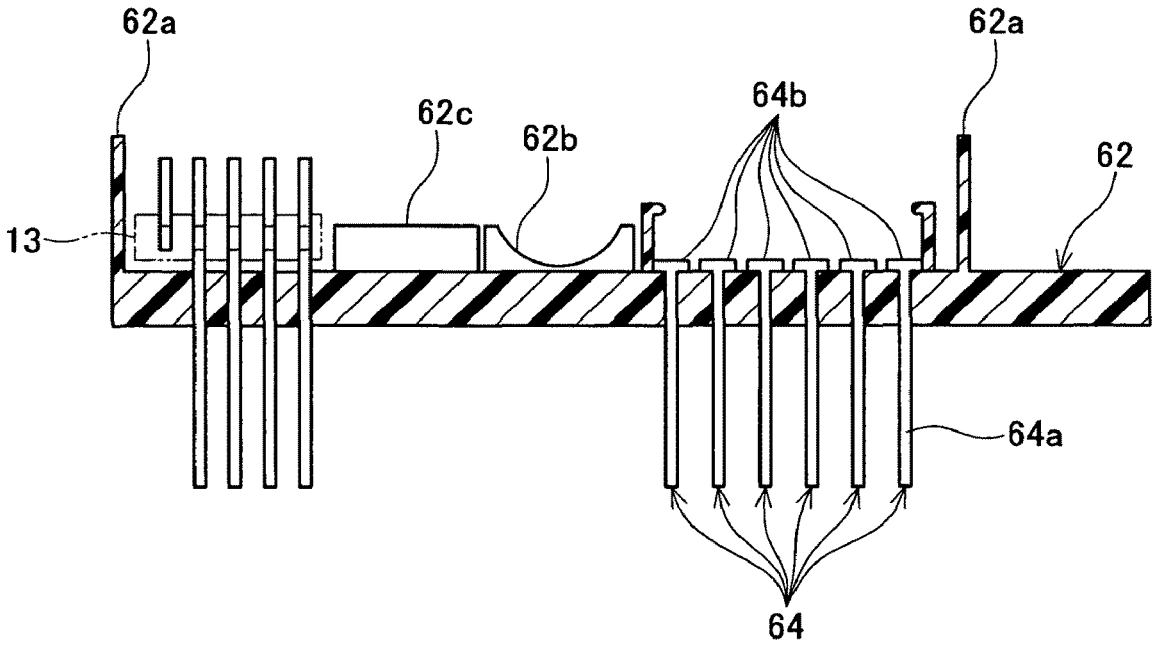
FIG. 14 is a figure for describing another embodiment of the present invention, and shows a state prior to the control module being attached to the set plate.

As shown in FIG. 13, the control module is mounted within the circuit case 14. The control module comprises a heat sink 44, electronic devices 46 and 48 fixed above the heat sink 44, a condenser 50, a choke coil 52, and a bus bar 56. The heat sink 44 is formed from a metal material that has a high coefficient of thermal conductivity (e.g. aluminum, copper). A bottom surface of the heat sink 44 makes contact with the heat radiating plates 32. The heat sink 44 is held above the heat radiating plates 32 by the holding portions 15*b*, 15*b*.

The electronic devices 46 and 48 fixed above the heat sink 44 include a diode, or a power transistor (MOS transistor, etc.). These electronic devices 46 and 48 form a pump driving circuit. The pump driving circuit converts direct current supplied from an external power source into a pump driving power source, and supplies this to the fuel pump.

The condenser 50 is fixed to the condenser holding part 15*c*, and the choke coil 52 is fixed to the coil holding part 15*d*. The condenser 50 and the choke coil 52 reduce the electrical noise generated by the electronic devices 46 and 48. The bus bar 56 connects the aforementioned devices (the electronic devices 46 and 48, the condenser 50, and the choke coil 52). One end of the bus bar 56 is connected to a terminal 13*b* of the connector 13. A lead wire 13*a* is connected to the terminal 13*b*. The other end of the lead wire 13*a* is connected to the fuel pump, etc.

Potting material 58 is filled between the circuit case 14 and the control module. The potting material 58 prevents moisture or dust from entering the control module. Thermal silicon, resin, or epoxy resin, for example, can be utilized in the potting material 58. Furthermore, alumina fiber (filler) can be mixed into these resins. The coefficient of thermal conductivity of the potting material 58 can be increased by adding the alumina filler.

Figure 7:
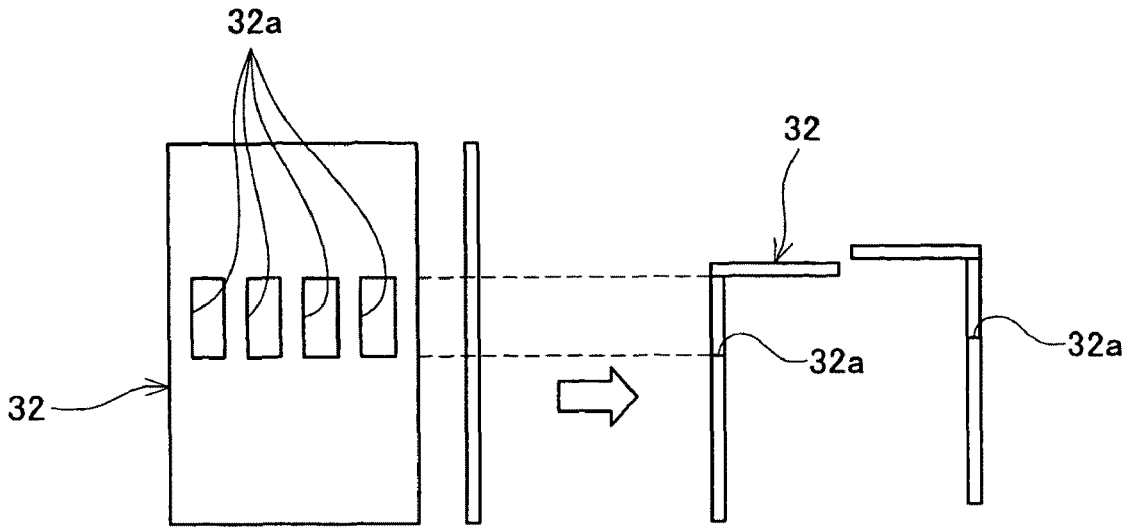
FIG. 7 shows a heat radiating plate in a state prior to being bent and in a state after being bent.

Next, the sequence of mounting the control module and the heat radiating plates 32 in the circuit case 14 will be described using FIGS. 7 to 13. As shown in FIG. 7, through holes 32*a* are first formed in the heat radiating plates 32. Then the heat radiating plates 32 are bent at substantially right angles at upper ends of the through holes 32*a*. Further, although the through holes 32*a* are formed in the heat radiating plates 32 in the present embodiment, it is equally possible that no through holes are formed in the heat radiating plates.

Figure 8:
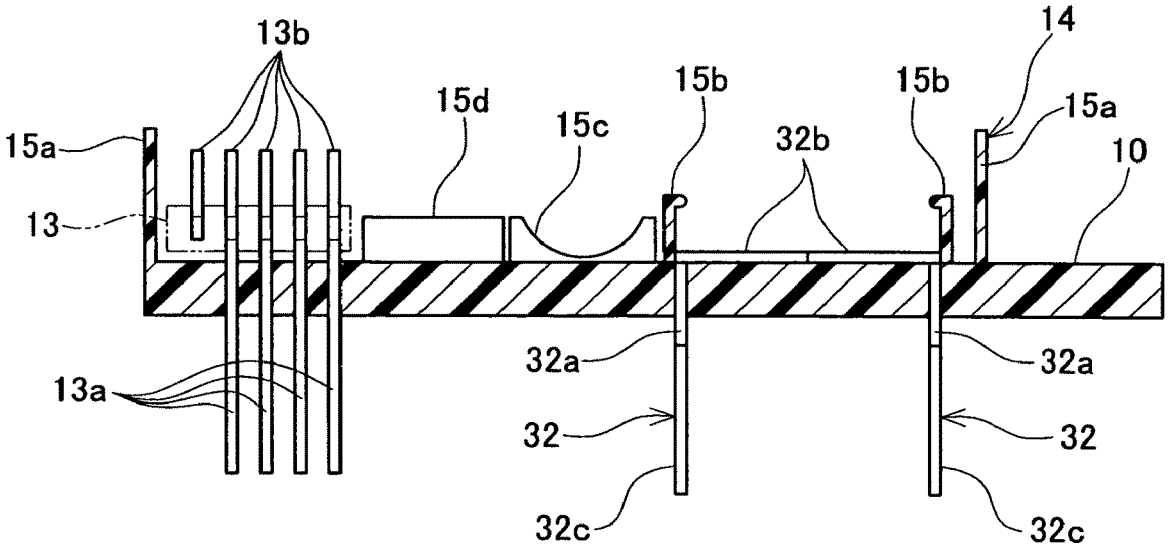
FIG. 8 describes the sequence for attaching the control module and the heat radiating plate to a circuit case.

Next, the heat radiating plates 32 and the connector 13 are disposed within a mold, and the set plate 10 is molded using a resin material. The set plate 10 after molding is shown in FIG. 8. As is clear from FIG. 8, the wall parts 15*a*, holding portions 15*b*, condenser holding part 15*c*, and coil holding part 15*b* (sic) of the circuit case 14 are formed integrally with the set plate 10. Further, the heat radiating plates 32 are insert molded in the set plate 10, and resin material is filled into the through holes 32*a* of the heat radiating plates 32. The heat radiating plates 32 can thus be fixed strongly in the set plate 10.

In the above example, the set plate 10 is molded while the heat radiating plates 32 are in a bent state. However, the heat radiating plates 32 may be molded integrally with the set plate 10, and then these heat radiating plates 32 may be bent. In the case where this method is adopted, the set plate 10 is molded while the upper ends and lower ends of the heat radiating plates 32 are being supported, and it is consequently possible to prevent pressure from the resin during molding from causing the heat radiating plates 32 to fall over. Further, the heat radiating plates 32 that have been bent rise above the upper surface of the set plate 10 due to spring back. As a result, when the heat sink 44 is disposed on the heat radiating plates 32, the heat radiating plates 32 exert upward pressure on the heat sink 44. The heat sink 44 is consequently held firmly by the holding portions 15*b*.

Figure 9:
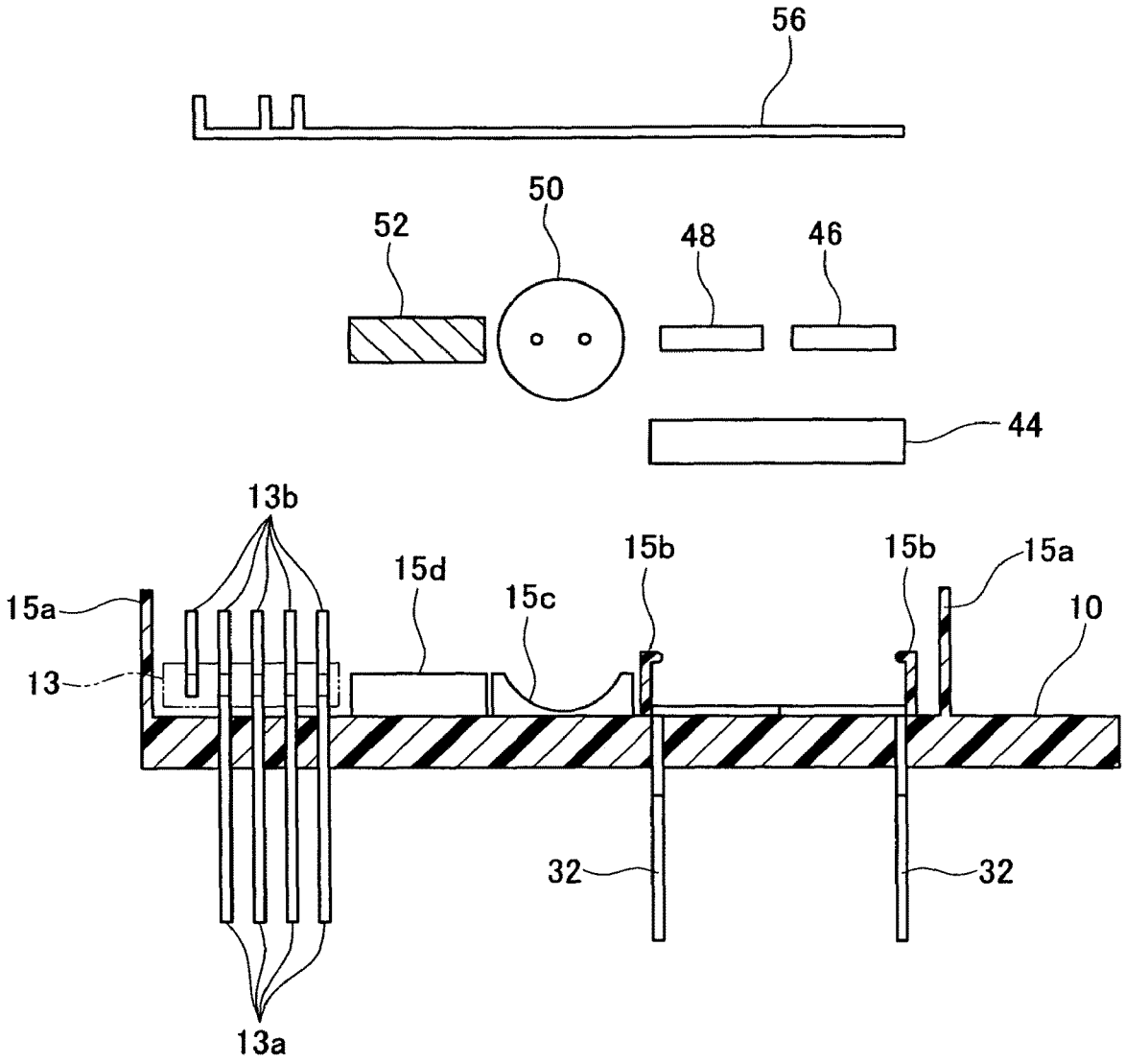
FIG. 9 describes the sequence for attaching the control module and the heat radiating plate to the circuit case.
Figure 10:
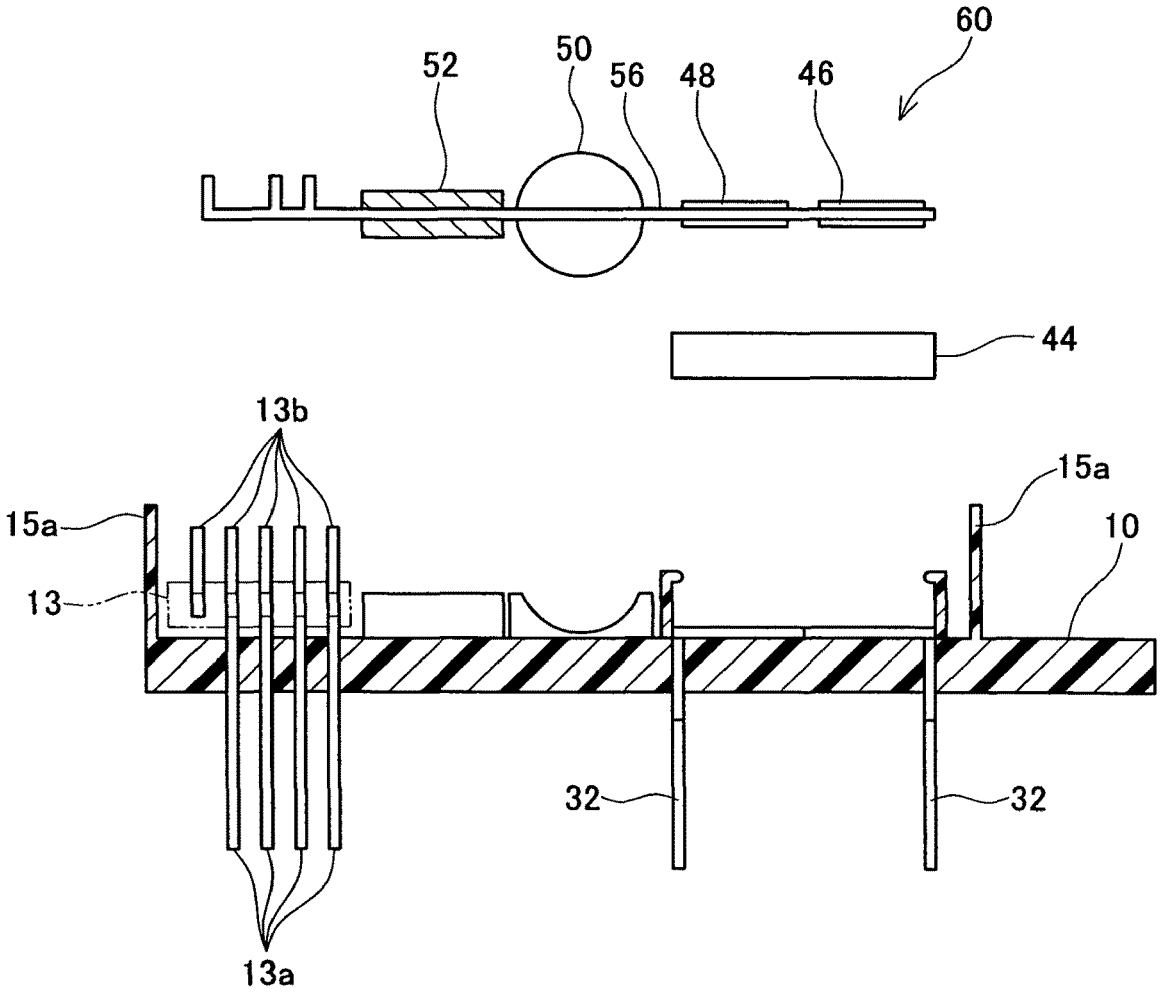
FIG. 10 describes the sequence for attaching the control module and the heat radiating plate to the circuit case.
Figure 11:
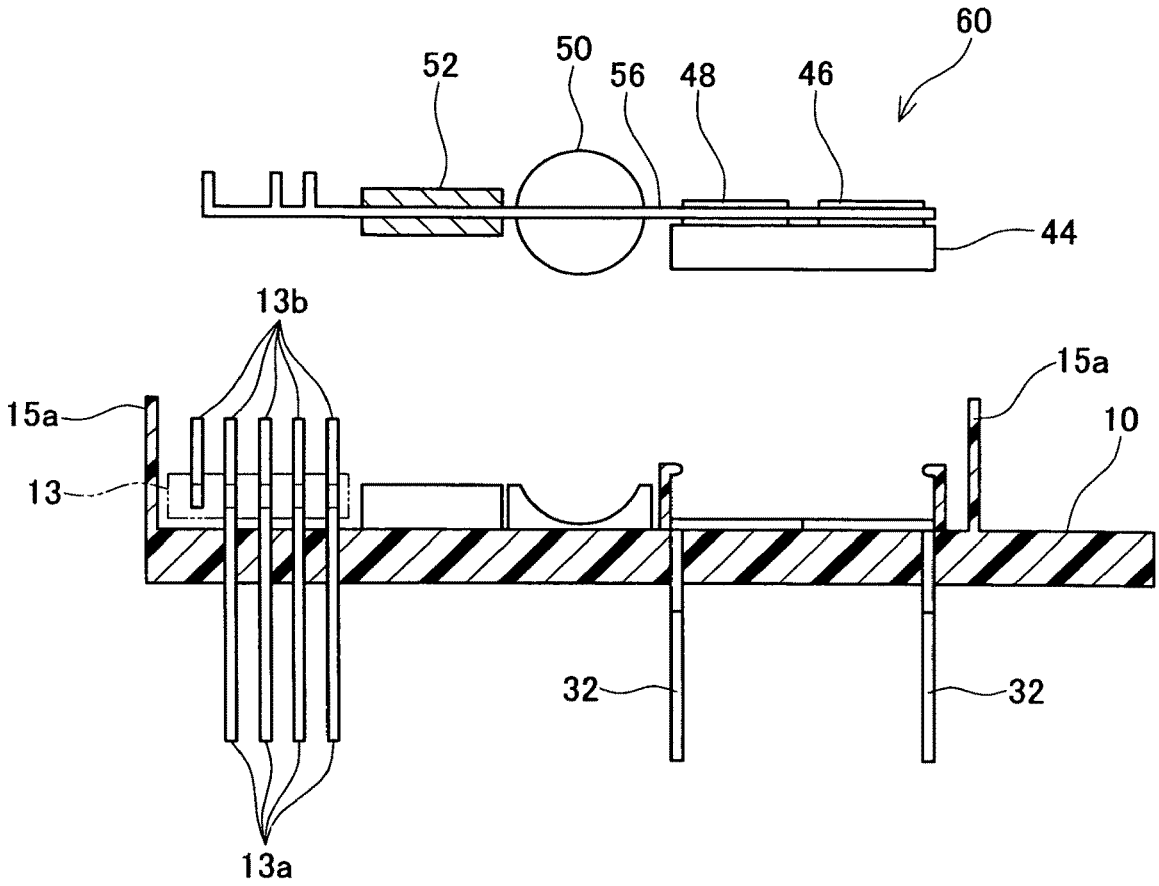
FIG. 11 describes the sequence for attaching the control module and the heat radiating plate to the circuit case.
Figure 12:
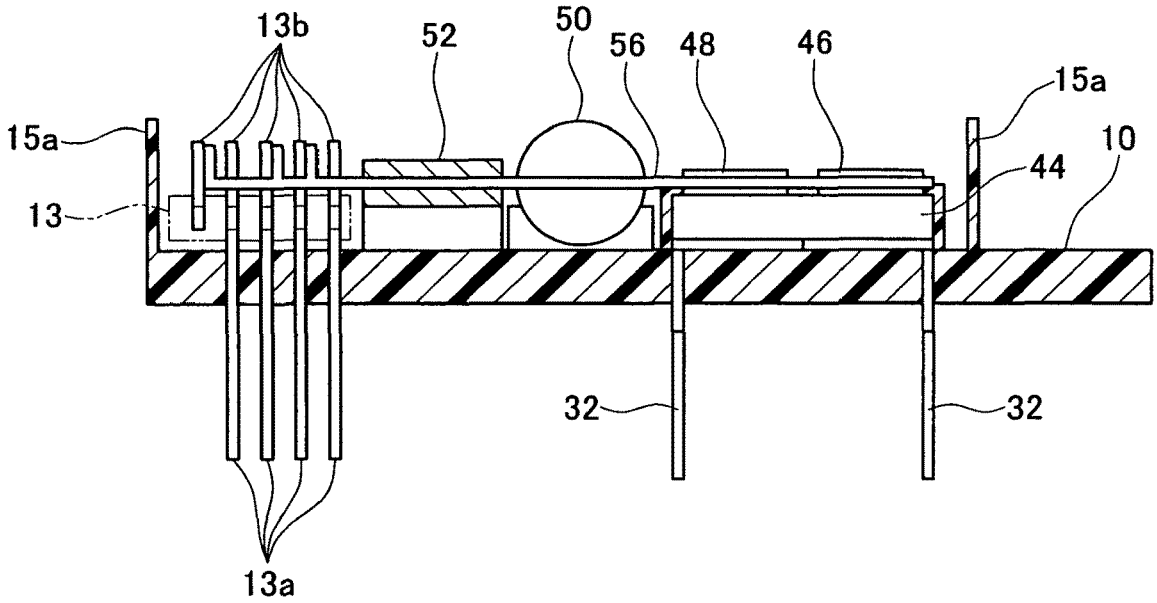
FIG. 12 describes the sequence for attaching the control module and the heat radiating plate to the circuit case.

After the set plate 10 has been molded the control module is mounted on the set plate 10. FIG. 9 shows an exploded view of the parts (44, 46, 48, 50, 52, 56) of the set plate 10 and the control module.

In the present embodiment, the electronic devices 46 and 48, the condenser 50, and the choke coil 52 are first fixed to the bus bar 56 (i.e. a control module 60 is formed (the state shown in FIG. 10)). Next, the heat sink 44 is fixed to lower faces of the electronic devices 46 and 48 of the control module 60 (the state shown in FIG. 11). Then, the control module 60 to which the heat sink 44 has been fixed is mounted at a predetermined position of the set plate 10, and the bus bar 56 and the terminal 13*b* of the connector 13 are connected (the state shown in FIG. 12). Finally, the circuit case 14 is filled with the potting resin 58 (the state shown in FIG. 13). The parts (44, 46, 48, 50, 52, 56) comprising the control module are thus unitized in this method before being mounted in the set plate 10, and consequently the control module can be mounted efficiently in the set plate 10.

The method of mounting the control module in the set plate 10 is not restricted to the above example. For example, the parts (44, 46, 48, 50, 52, 56) comprising the control module may be mounted separately in the set plate 10. Alternatively, the bus bar 56 may be molded integrally when the set plate 10 is molded, and the electronic devices 46 and 48, etc. may be fixed to the bus bar 56 that was molded integrally.

The operation of the fuel supply device 1 having the configuration described above will now be described. The electronic devices 46 and 48 of the control module operate (i.e. perform switching of a switching element such as the power transistor or the like) when a control signal for commanding the driving of the fuel pump is input to the control module. The direct current supplied from the external power source is thus converted into a pump driving voltage, is output to the fuel pump, and the electric motor within the fuel pump begins to rotate.

When the electric motor of the fuel pump rotates, the fuel within the fuel tank 34 passes through the suction filter 26 and is sucked into the fuel pump. The pressure of the fuel that has been sucked into the fuel pump increases, then the fuel is discharged via the fuel discharge hole of the fuel pump. The pressure of the fuel that has been discharged from the fuel pump is adjusted by the pressure regulator 36, then the fuel flows along the connecting pipe 38 into the filter case 22. The fuel that has flowed into the filter case 22 has foreign matter. This foreign matter may include very small matter, which is removed therefrom by a fuel filter housed in the filter case 22, and is then discharged from the fuel discharging hole 42. The fuel that has been discharged from the fuel discharging hole 42 flows through the discharging pipe 11 on the upper surface of the set plate 10 and is fed to the engine.

When the electronic devices 46 and 48 of the control module operate (i.e. when the switching elements of the control module perform switching), the electronic devices 46 and 48 generate heat. The heat generated by the electronic devices 46 and 48 is transmitted via the heat sink 44 to the upper end portions of the heat radiating plates 32. The lower ends of the heat radiating plates 32 pass through the set plate 10, protrude into the fuel tank 34, and these lower ends extend to the vicinity of the lower end of the fuel supply device 1. As a result, the lower ends of the heat radiating plates 32 are immersed in the fuel stored within the fuel tank 34, and the heat transmitted to the heat radiating plates 32 is transferred to the fuel stored within the fuel tank 34. The electronic devices 46 and 48 are thus cooled.

Further, surplus fuel, of the fuel that is discharged from the fuel pump, is returned into the fuel tank 34 by the pressure regulator 36. Since the fuel that is returned into the fuel tank 34 from the pressure regulator 36 is discharged toward the heat radiating plates 36, the fuel returned from the pressure regulator 36 flies across, makes contact with and thus cools the heat radiating plates 34 even when the amount of fuel within the fuel tank 34 has been significantly reduced. The heat radiating plates 32 are thus cooled efficiently.

As is clear from the above description, the heat generating electronic devices 46 and 48 of the control module are connected to the upper ends of the heat radiating plates 32 via the heat sink 44, and the lower ends of the heat radiating plates 32 are immersed in the fuel in the fuel tank 34. As a result, the heat radiating plates 32 can make contact with the fuel stored in the fuel tank 34 irrespective of the rate of flow of the fuel discharged from the fuel pump, and the heat of the electronic devices 46 and 48 can be radiated to the fuel in the fuel tank 34. Since the heat of the control module is radiated to the fuel in the fuel tank 34, it is possible to suppress excessive heating of the fuel that is fed from the fuel pump to the engine. It is thus possible to suppress air bubbles from being mixed into the fuel fed to the engine, and the engine can consequently perform combustion with an adequate air-fuel ratio.

Further, since the cooling capacity for cooling the electronic devices 46 and 48 can be adjusted using the area of the heat radiating plates 32, it is easily possible to obtain the desired cooling capacity. Further, since the surplus fuel, that is discharged from the fuel pump and is returned by the pressure regulator 36 is discharged toward the heat radiating plates 32, the heat radiating plates 32 can be cooled efficiently even when the amount of fuel stored within the fuel tank 34 has been significantly reduced.

Moreover, in the fuel supply device 1, an increase in size of the fuel supply device 1 in the radial direction is prevented by disposing the heat radiating plates 32 on the outer peripheral side of the fuel pump case 30 at the portion where the filter case 22 is not disposed. It is thus possible to increase the ease of mounting on the fuel tank 34 while at the same time efficiently cooling the electronic devices 46 and 48.

In the embodiment described above, the control module (specifically, the heat generating electronic devices) utilizes cooling plates for cooling. However, the present invention is not restricted to this example. For instance, cooling rods 64 can be utilized as shown in FIGS. 14 to 20.

Figure 15:
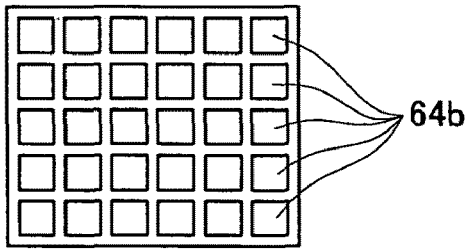
FIG. 15 is a plan view showing a state where a cooling rod has been molded integrally with the set plate.
Figure 16:
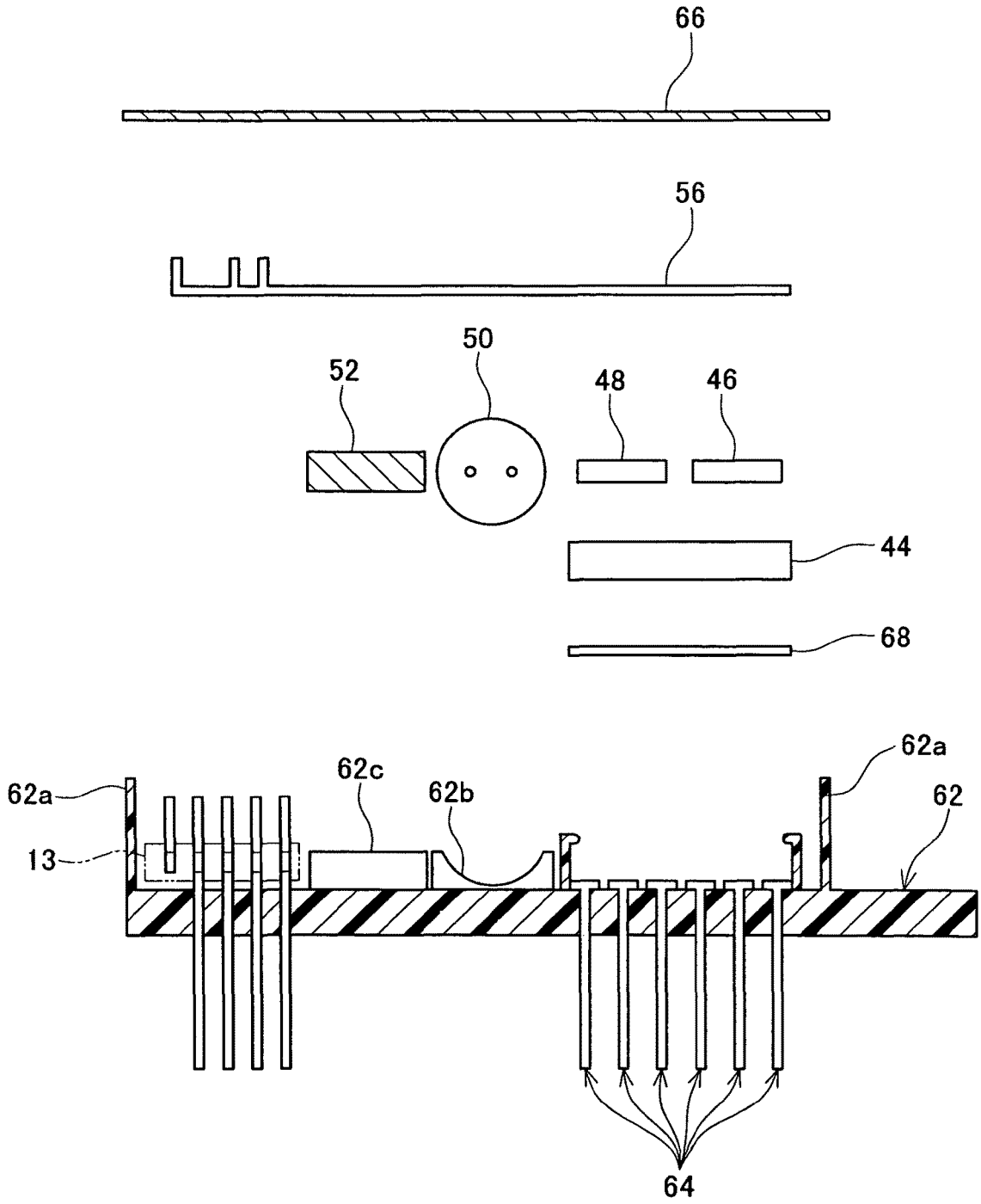
FIG. 16 describes the sequence for attaching the control module to the set plate shown in FIG. 14.
Figure 17:
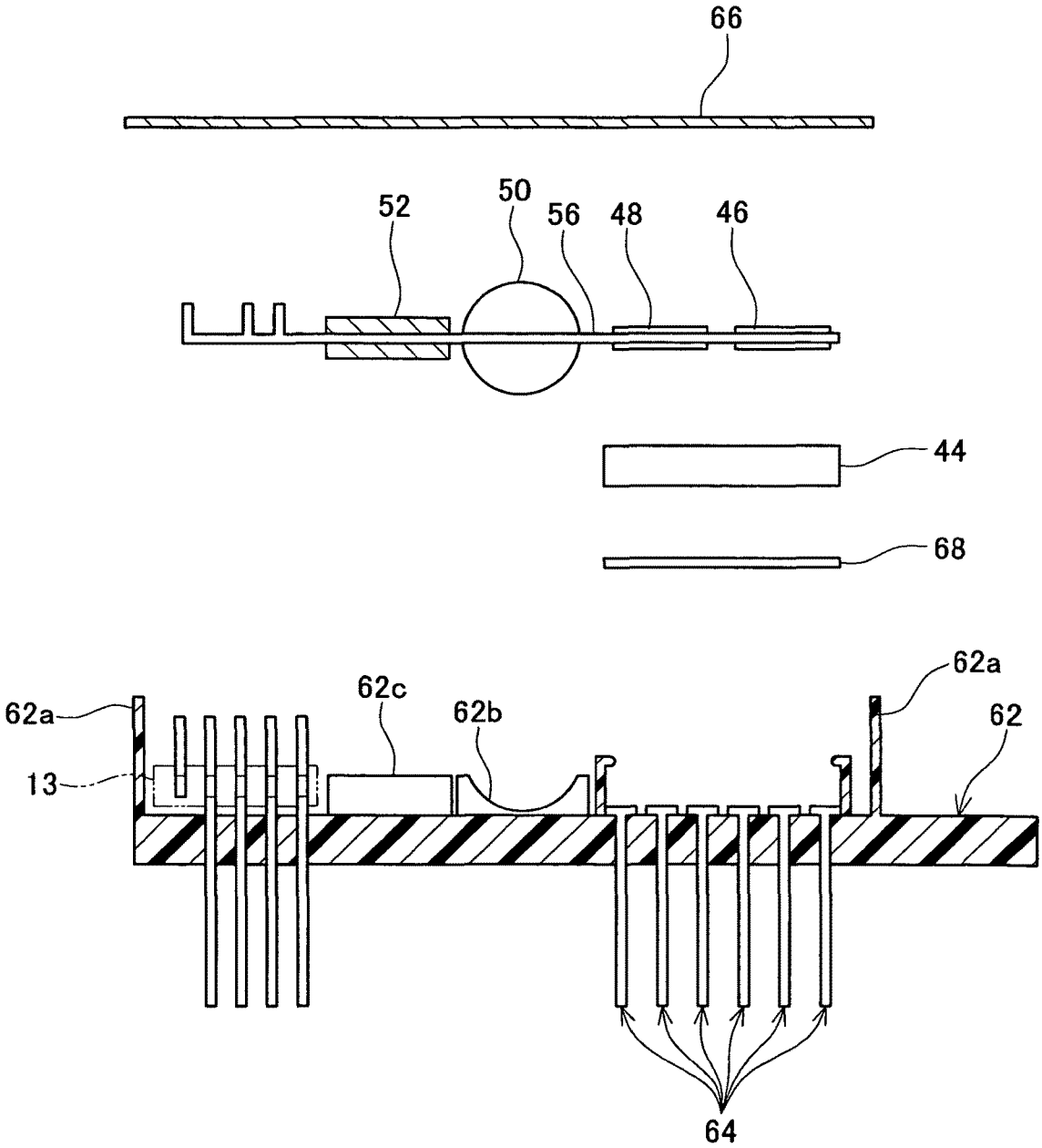
FIG. 17 describes the sequence for attaching the control module to the set plate shown in FIG. 14.

In the example shown in FIGS. 14 to 20, the cooling rods 64 each comprise a plate-shaped head part 64*b* and a rod-shaped part 64*a* that extends downward from the head part 64*b*. The cooling rods 64 are molded integrally with a set plate 62, lower surfaces of the head parts 64*b* make contact with an upper surface of the set plate 62, and the rod-shaped parts 64*a* of the cooling rods 64 pass through the set plate 62 and extend into the fuel tank from a lower surface of the set plate 62. Further, the cooling rods 64 shown in FIG. 15 are disposed regularly on the set plate 62 with a predetermined space therebetween. Cooling rods 64 are thus disposed efficiently within a small area.

The sequence for mounting the control module on the set plate 62 can be performed using substantially the same method as in the embodiment already described. That is, first the electronic devices 46 and 48, the condenser 50, and the choke coil 52 are connected to the bus bar 56 (proceeding from the state shown in FIG. 16 to the state shown in FIG. 17). Then the upper surface of the heat sink 44 is fixed to the lower surface of the electronic devices 46 and 48 (proceeding from the state shown in FIG. 17 to the state shown in FIG. 18). Then the control module is mounted on the set plate 62 such that the lower surface of the heat sink 44 makes contact with the upper surface of the head parts 64*b* of the cooling rods 64 (proceeding from the state shown in FIG. 18 to the state shown in FIG. 19).

Figure 18:
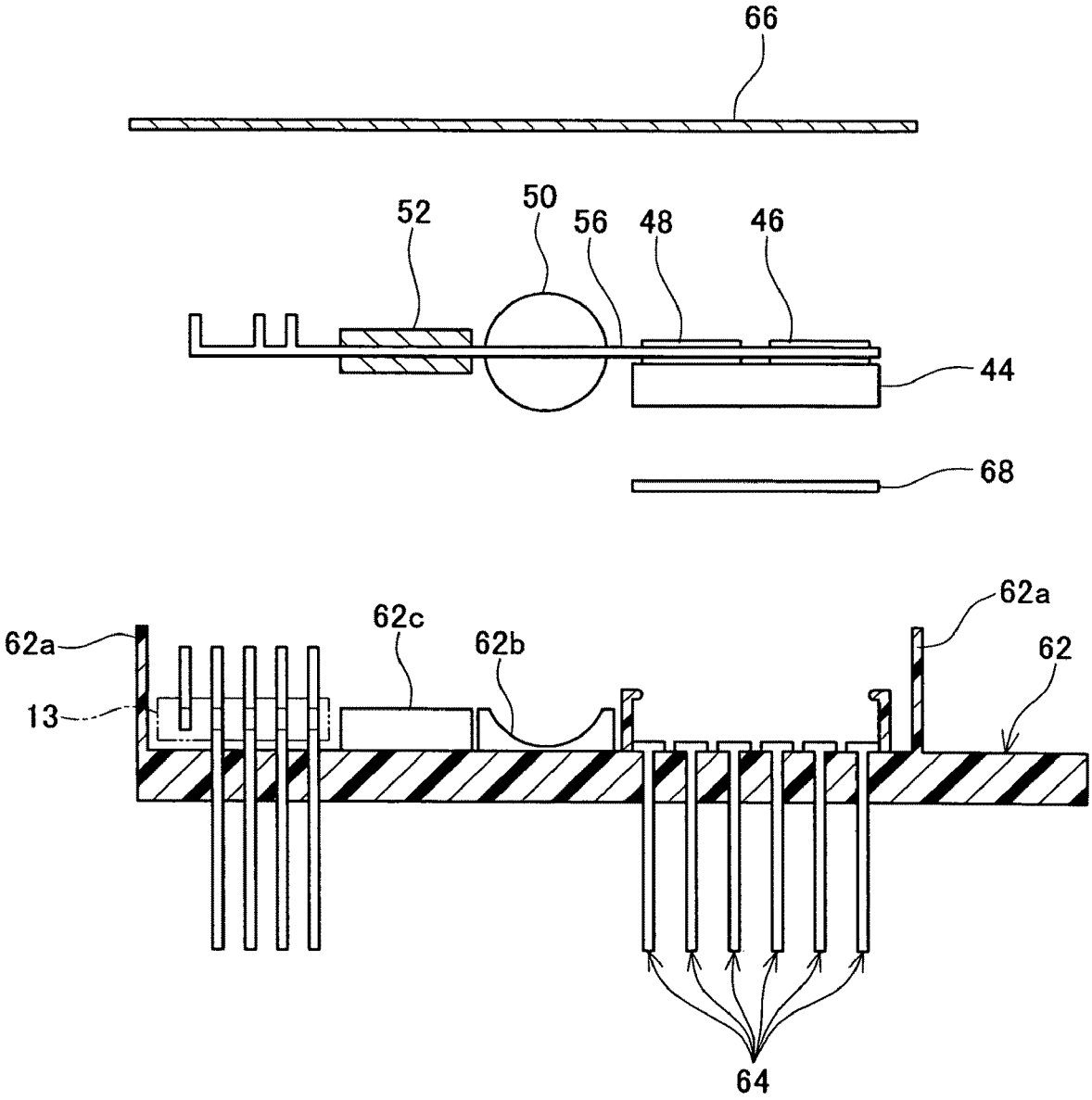
FIG. 18 describes the sequence for attaching the control module to the set plate shown in FIG. 14.
Figure 19:
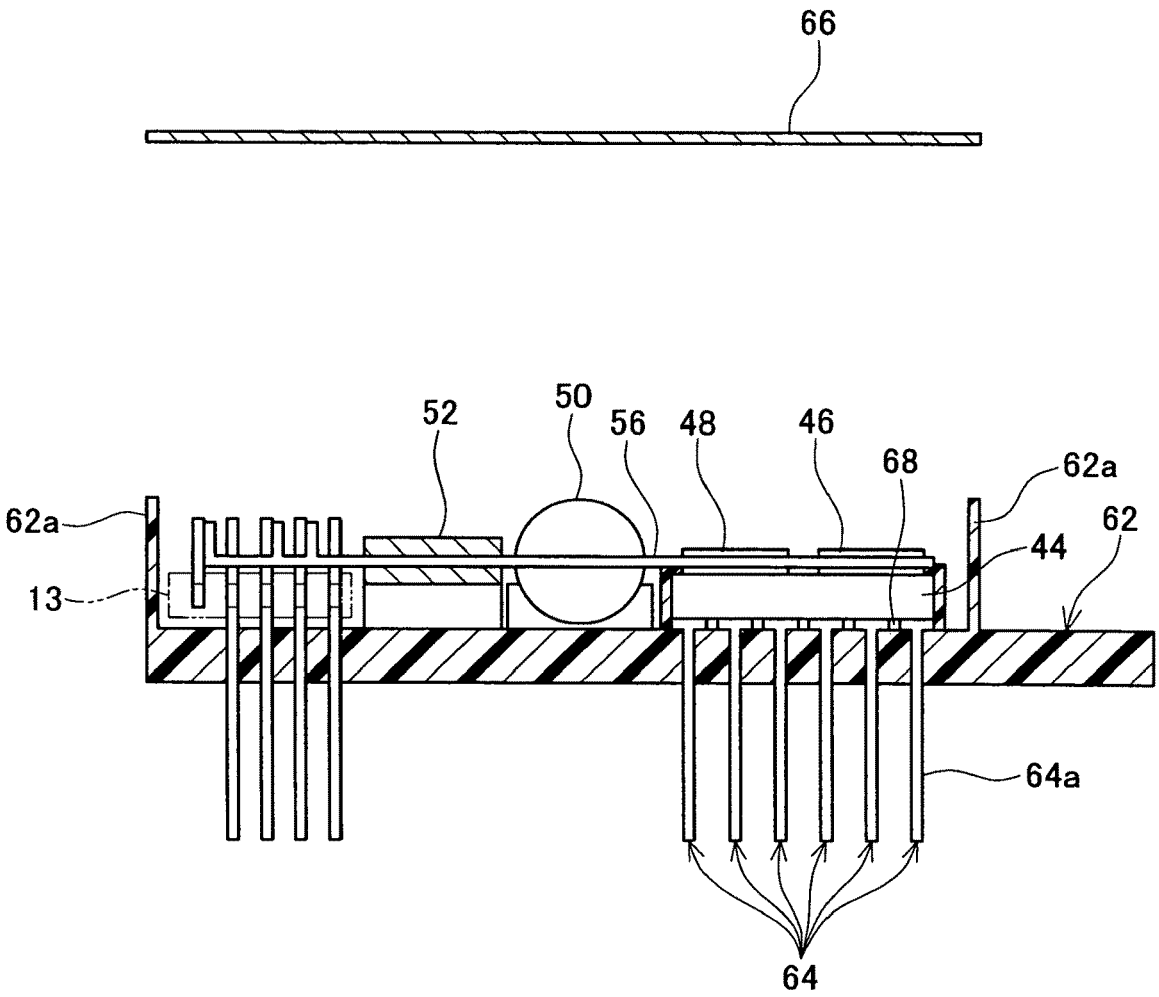
FIG. 19 describes the sequence for attaching the control module to the set plate shown in FIG. 14.
Figure 20:
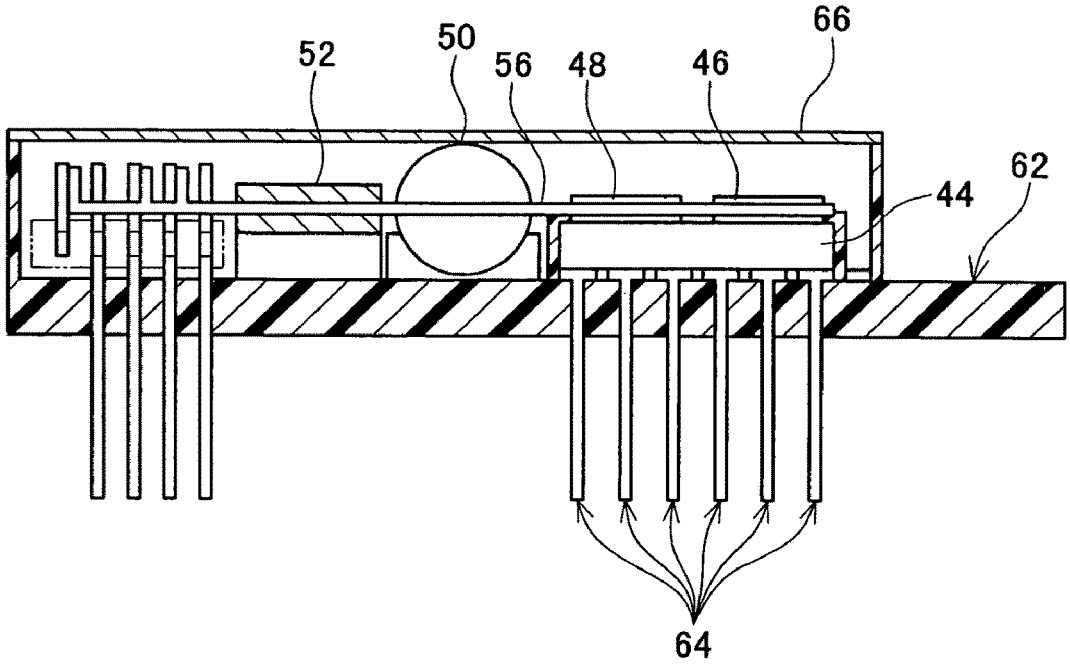
FIG. 20 describes the sequence for attaching the control module to the set plate shown in FIG. 14.

In the case where the cooling rods 64 are utilized, silicon gel 68 is injected into the spaces between the cooling rods 64 (see FIGS. 18 and 19). The boundary between the cooling rods 64 and the set plate 62 is sealed by injecting the silicon gel 68 into the spaces between the cooling rods 64. It is preferred that a material with a high coefficient of thermal conductivity is utilized in the silicon gel 68. Further, as is clear from FIG. 20, upper ends of the circuit case are sealed by a cover 66 in this example.

In the case where cooling rods 64 are utilized, as described above, the area where the cooling rods 64 and the fuel within the fuel tank make contact can be made greater than the volume of the cooling rods 64. As a result, it is possible to realize sufficient cooling capacity even if the heat sink is made smaller (i.e. even if the area on which the cooling rods 64 are disposed is made smaller). Furthermore, the control module can be made smaller.

Moreover, as in the embodiment already described, it is possible to adopt a configuration in which the fuel returning from the pressure regulator is made to fly toward the cooling rods 64. Further, the rod-shaped parts 64*b* of the cooling rods 64 may be disposed at the outer peripheral side of the fuel pump case at the portion where the filter case is not disposed.

Furthermore, in the aforementioned embodiment, the fuel returned from the pressure regulator 36 is discharged toward the heat radiating plates 32. However, the fuel returned from the pressure regulator 36 may equally well be discharged toward the lower surface of the set plate 10 (the position at which the heat sink 44 is disposed). With this configuration, as well, the fuel returned from the pressure regulator 36 can be utilized effectively to cool the control module.

Second Embodiment

Figure 21:
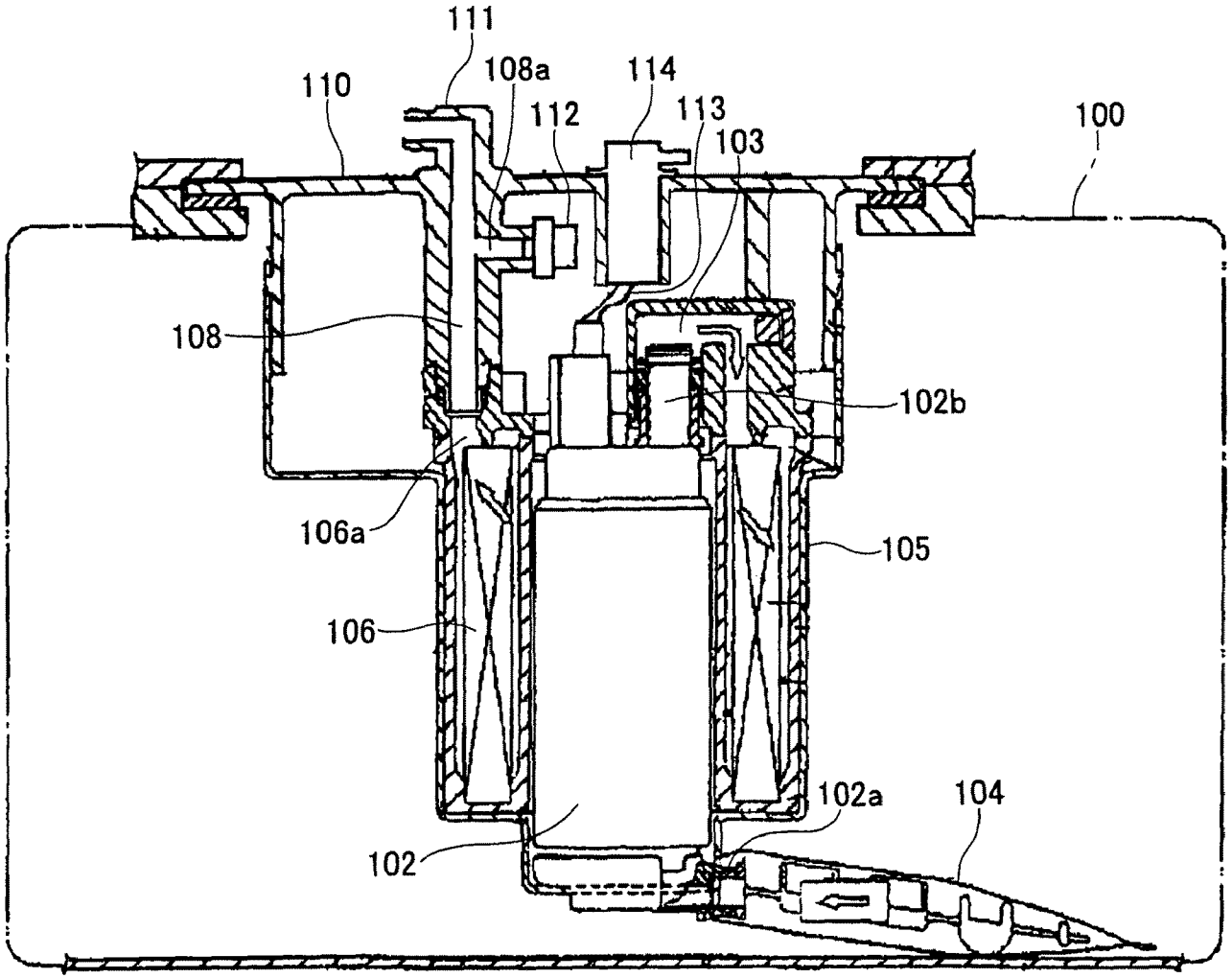
FIG. 21 shows the entire configuration of a fuel supply device of a second embodiment.
Figure 22:
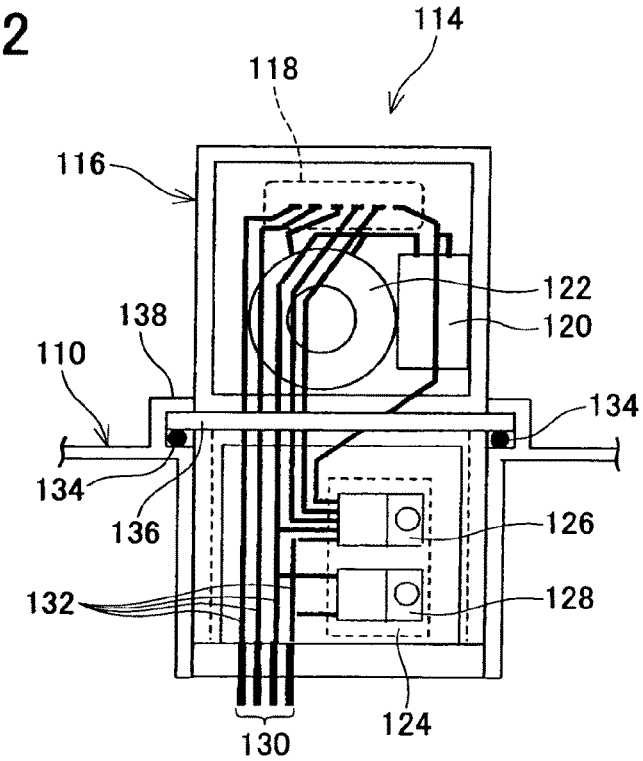
FIG. 22 is a layout drawing schematically showing the layout of parts of a control circuit part shown in FIG. 21.
Figure 23:
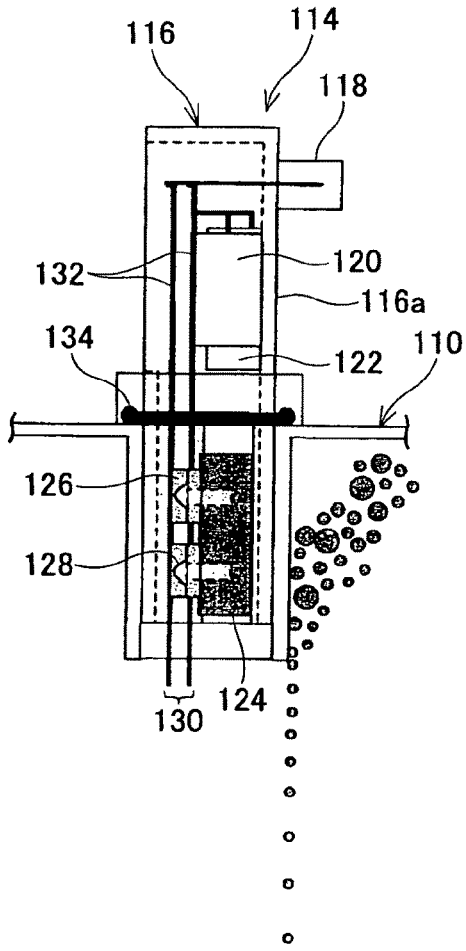
FIG. 23 is a layout drawing of the parts when the control circuit part shown in FIG. 22 is viewed from the side.

Next, a fuel supply device of a second embodiment of the present invention will be described with reference to FIGS. 21 to 23. As shown in FIG. 21, the fuel supply device of the second embodiment comprises a set plate 110 attached to a mounting hole of a fuel tank 100. The set plate 110 is molded from insulating resin material. A fuel discharging passage 108 is formed in the set plate 110. A branching passage 108*a* is formed in a center of the fuel discharging passage 108. A pressure regulator (relief valve) 112 is attached to a tip of the branching passage 108*a*. A discharging pipe attaching part 111 is formed at a tip of the fuel discharging passage 108. A discharging pipe (not shown) is attached to the discharging pipe attaching part 111. An injector (not shown) is attached to the other end of the discharging pipe, and fuel is fed to an engine from the injector.

A control circuit part 114 is attached substantially perpendicular to the set plate 110. An upper part of the control circuit part 114 protrudes upward past the set plate 110, and a lower part of the control circuit part 114 protrudes into the fuel tank 100. The lower part of the control circuit part 114 faces a fuel discharge hole of the pressure regulator 112. Fuel discharged from the pressure regulator 112 is discharged to the control circuit part 114.

A casing 105 is attached to a lower face of the set plate 110. A fuel pump 102 and a fuel filter 106 are housed within the casing 105. Electric power is supplied from the control circuit part 114 to the fuel pump 102 via a lead wire 113. A suction filter 104 is attached to a fuel intake hole 102*a* of the fuel pump 102. The suction filter 104 removes large foreign matter from the fuel sucked into the fuel pump 102. A fuel filter 106 is connected to a fuel discharge hole 102*b* of the fuel pump 102 via a fuel passage 103. The fuel filter 106 removes small foreign matter from the fuel discharged from the fuel pump 102 (i.e. foreign matter smaller than that removed by the suction filter 104). The fuel discharging passage 108 is connected to a fuel discharge hole 106*a* of the fuel filter 106.

In the fuel supply device described above, the fuel pump 102 operates when electric power is supplied from the control circuit part 114, and the fuel within the fuel tank 100 is sucked from the fuel intake hole 102*a* into the fuel pump 102 via the suction filter 104. The pressure of the fuel that has been sucked into the fuel pump 102 increases, then the fuel is discharged from the fuel discharge hole 102*b*. The fuel that has been discharged from the fuel discharge hole 102*b* has foreign matter removed therefrom by the fuel filter 106, and then flows along the fuel discharging passage 108. Part of the fuel flowing along the fuel discharging passage 108 is fed by the discharging pipe to the injector, and the remainder of the fuel is discharged into the fuel tank 100 by the pressure regulator 112. The present embodiment thus has a fuel circulating means that circulates the fuel in the fuel tank 100 by means of the branching passage 108*a* and the pressure regulator 112.

The fuel that is discharged by the pressure regulator 112 collides with the control circuit part 114, thus performing heat transfer with the control circuit part 114. The control module housed in the control circuit part 114 is thus cooled. When the control circuit part 114 reaches a high temperature, the fuel discharged to the control circuit part 114 vaporizes. When the discharged fuel vaporizes, the control circuit part 114 is cooled by the vapor latent heat. The control circuit part 114 is thus cooled effectively.

Next, the control circuit part 114 will be described in detail. The control circuit part 114 comprises a circuit case 116, and the control module housed within the circuit case 116.

The circuit case 116 is molded from resin material, and has a box shape and a square shaped cross-section. A connector 118 is formed at an upper part of the circuit case 116. The connector 118 is connected to an external power source and an ECU (electronic control unit) (not shown). A connector 130 is formed at a lower part of the circuit case 116. The fuel pump 102 is connected to the connector 130. The circuit case 116 is provided with an attaching part 136. Both ends of the attaching part 136 are supported by supporting portions 134, and the circuit case 116 is thus attached to the set plate 110. A pressing portion 138 is formed on the set plate 110, and the attaching part 136 and the supporting portions 134 are held by the pressing portion 138. The circuit case 116 is thus firmly mounted on the set plate 110.

The control module comprise parts 120, 122, 126, 128, etc. disposed on one surface 116*a* of the circuit case 116 (i.e. on one of the two surfaces that have the widest areas, of the six surfaces comprising the circuit case 116). The surface 116*a* on which the parts 120, 122, 126, 128, etc. are disposed is substantially perpendicular to the set plate 110. The fuel that is discharged from the pressure regulator 112 is discharged to an outer side of the surface 116*a*.

The part 122 disposed above the set plate 110 is a choke coil, and the part 120 is a condenser. The parts 126 and 128 disposed below the set plate 110 are heat generating electronic devices such as power transistors, etc. The parts 126 and 128 are attached to the circuit case 116 (specifically, to the surface 116*a* of the circuit case 116) via a heat sink 124. As a result, the heat generated by the parts 126 and 128 is efficiently transmitted to the circuit case 116 via the heat sink 124. Moreover, the connectors 118 and 130, and the electronic parts 120, 122, 126, and 128 are connected by a bus bar 132.

As is clear from the above description, in the fuel supply device of the second embodiment, the control circuit part 114 is cooled by the circulating part of the fuel, of the fuel discharged from the fuel pump 102, that is returned into the fuel tank 100 from the pressure regulator 112. The fuel supplied to the engine from the fuel pump 102 is consequently not heated excessively, and it is possible to suppress the formation of air bubbles within the discharging pipe. The desired amount of fuel can therefore be fed to the engine, and the air-fuel ratio can consequently be controlled accurately.

Further, when the running state of the engine changes (i.e. when the amount of fuel consumed by the engine changes), the amount of fuel fed to the engine from the fuel pump 102 changes greatly, but the amount of fuel returned into the fuel tank 100 by the pressure regulator 112 does not change greatly, and only a certain amount of fuel is returned into the fuel tank 100. For example, the amount of fuel fed to the engine from the fuel pump 102 is extremely small while the engine is idling, and a larger amount of fuel is returned to the fuel tank 100 by the pressure regulator 112 than is fed to the engine. In the fuel supply device of the second embodiment, the control circuit part 114 is cooled by the fuel discharged from the pressure regulator 112, and consequently the control circuit part 114 can be cooled sufficiently irrespective of the running state of the engine.

Further, in the present embodiment, the heat generating electronic devices 126 and 128 of the control module are disposed at the inner side of the fuel tank 100, and the parts 120 and 122 that generate a smaller amount of heat are disposed at the outer side of the fuel tank 100. As a result, the fuel discharged from the pressure regulator 112 makes contact with the part where the heat generating electronic devices 126 and 128 are disposed, and the control module can be cooled effectively.

Further, in the present embodiment, a part of the control circuit part 114 is made to protrude into the fuel tank 100 by attaching the control circuit part 114 substantially perpendicular to the set plate 110. As a result, the control circuit part 114 is immersed directly in the fuel in the fuel tank 100 when a large amount of fuel is being stored in the fuel tank 100. Thus, the control circuit part 114 can be cooled effectively.

Moreover, in the second embodiment, the control circuit part 114 is cooled utilizing the fuel discharged from the pressure regulator 112. However, the present invention is not limited to this example. For example, a configuration such as that shown in FIG. 24 may be adopted.

Figure 24:
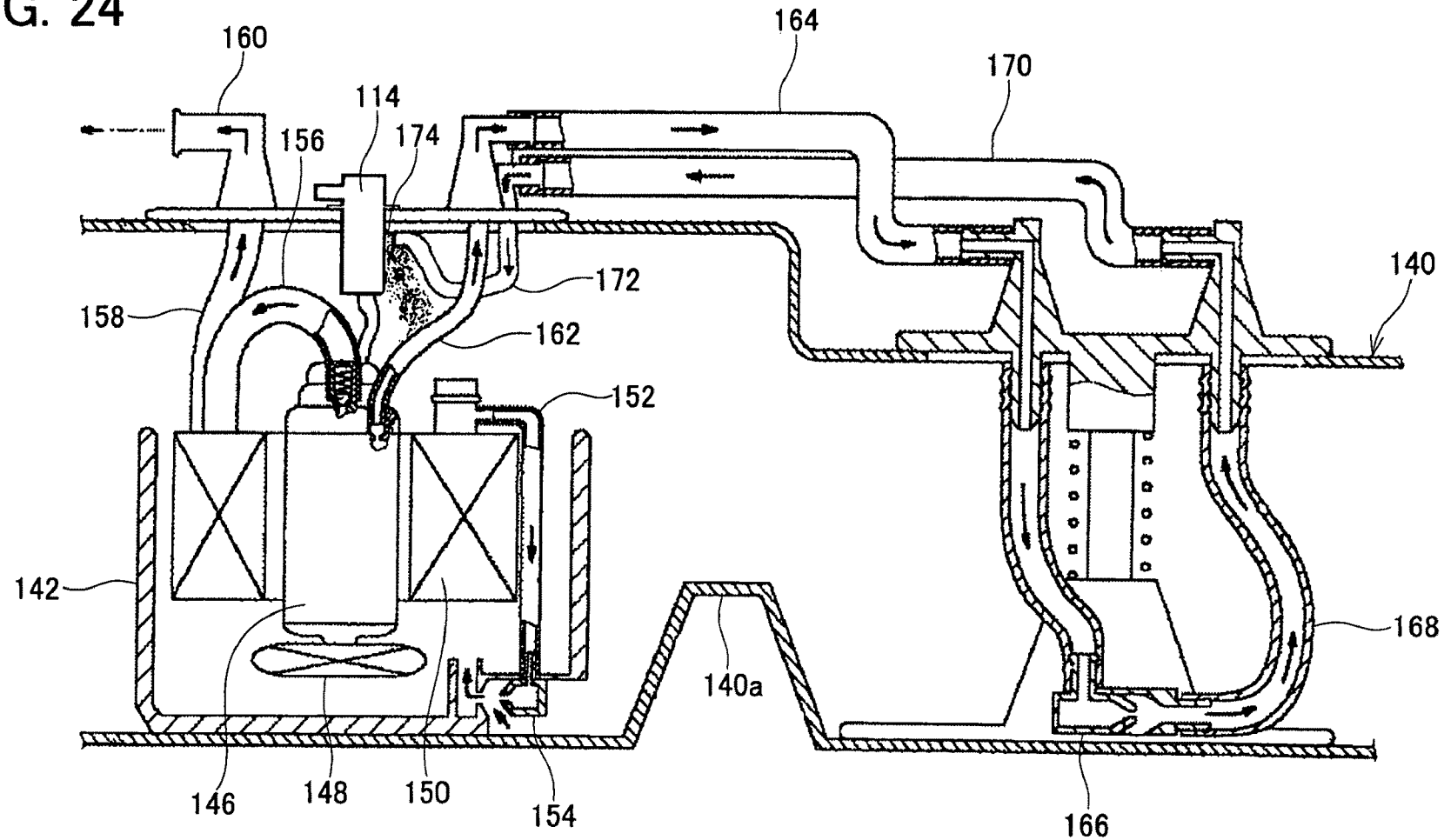
FIG. 24 is a variant of the fuel supply device shown in FIG. 21.

The fuel supply device shown in FIG. 24 is set within a saddle-shaped fuel tank 140. The fuel tank 140 is divided into a main tank chamber and a sub tank chamber by a separating part 140*a*. A reserve cap 142 is disposed in the main tank chamber, and a suction filter 148, a fuel pump 146, and a fuel filter 150 are disposed within the reserve cap 142. A part of the fuel discharged from the fuel pump 146 is fed to a jet pump 166 (to be described later) via a fuel discharging pipe 162, and the remaining fuel is fed along a fuel discharging pipe 156 to the fuel filter 150. A part of the fuel discharged from the fuel filter 150 flows along a fuel piping 152, and the remaining fuel is discharged to the exterior of the fuel tank 140 via a fuel discharging passage 158 and a fuel discharging hole 160. A jet pump 154 is disposed at a tip of the fuel piping 152. Fuel is discharged from the jet pump 154 into the reserve cap 142, thus drawing the fuel within the main tank chamber into the reserve cap 142.

The jet pump 166 is disposed within the sub tank chamber of the fuel tank 140. The fuel discharging pipe 162 is connected to the jet pump 166 via a fuel piping 164. As a result, a part of the fuel discharged from the fuel pump 146 is fed to the jet pump 166. A fuel intake pipe 168 is disposed adjacent to the jet pump 166. Fuel discharged from the jet pump 166 flows along the fuel intake pipe 168. By discharging the fuel from the jet pump 166 toward the fuel intake pipe 168, the fuel within the sub tank chamber is drawn into the fuel intake pipe 168. A fuel piping 170 is connected to the fuel intake pipe 168, and a fuel discharge pipe 172 is connected to the fuel piping 170. The fuel that has been drawn into the fuel intake pipe 168 by the jet pump 166 is consequently discharged into the main tank chamber from the fuel discharge pipe 172. The fuel that has been discharged from the fuel discharge pipe 172 is discharged toward the control circuit part 114, thus being utilized to cool the control circuit part 114. As a result, in the example shown in FIG. 24, the fuel discharging pipe 162, the fuel pipings 164 and 170, the jet pump 166, the fuel intake pipe 168 and the fuel discharge pipe 172 constitute a fuel circulating means for circulating the fuel that is within the fuel tank 140.

In the fuel supply device shown in FIG. 24, as well, the control circuit part 114 is cooled by the fuel circulating within the fuel tank 140, and consequently excessive heating can be suppressed of the fuel fed from the fuel supply device to the engine.

Further, in the aforementioned embodiment, the fuel is discharged directly onto the control circuit part 114, thereby cooling the control circuit part 114. However, the present invention is not restricted to this configuration. For example, the control circuit part can be provided with a heat radiating plate, and the fuel can be discharged onto this heat radiating plate. Moreover, in the examples described below, the basic configuration of the control circuit part is the same as that of the control circuit part 114 shown in FIGS. 22 and 23. Consequently the same numbers will be applied to identical parts, a description thereof will be omitted, and only differing parts will be described.

Figure 25:
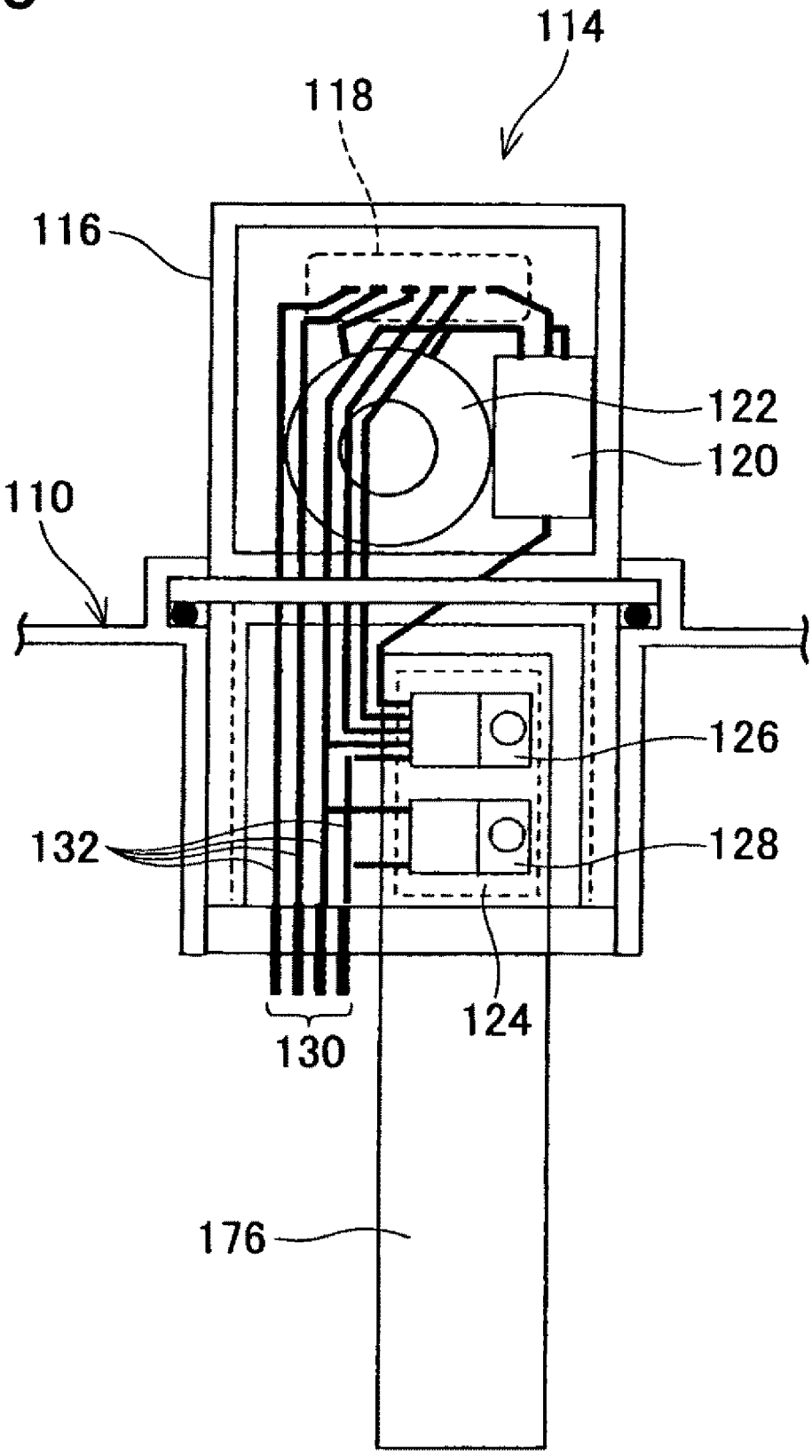
FIG. 25 is a layout drawing schematically showing the layout of parts of a control circuit part of a variant of FIG. 22.
Figure 26:
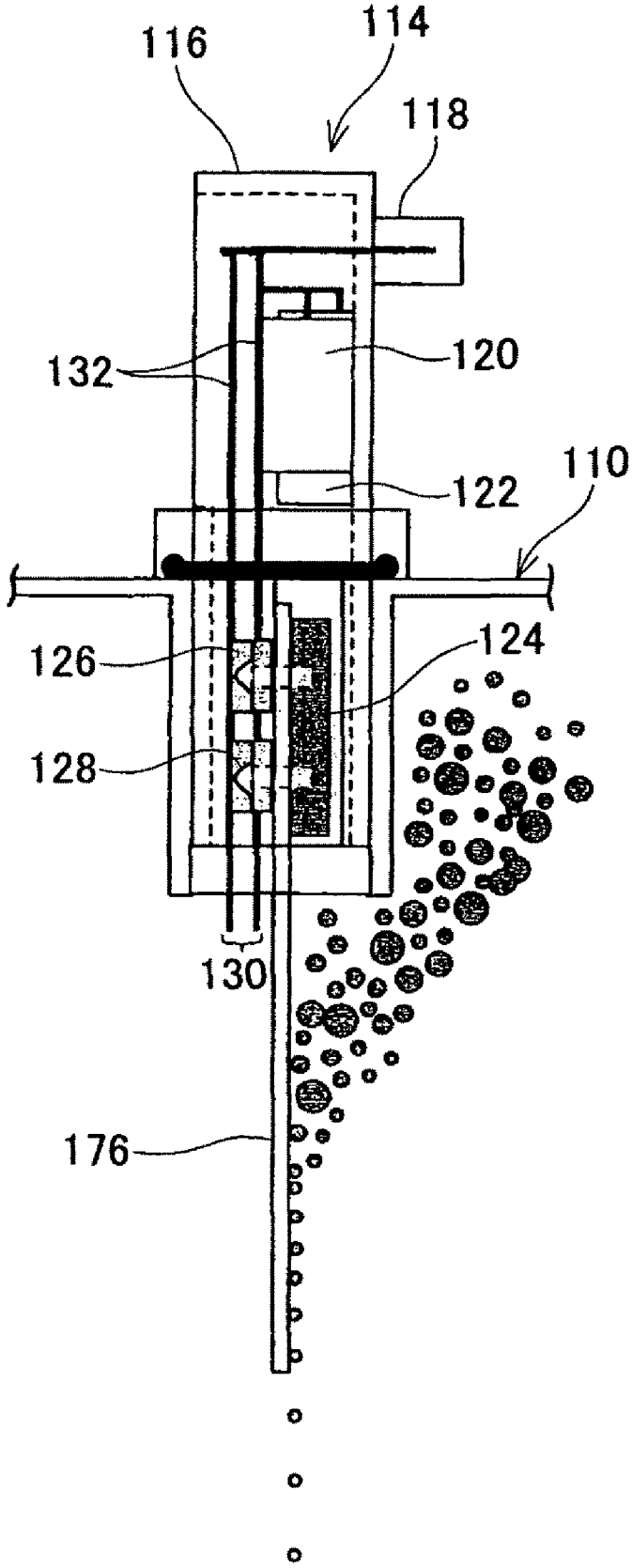
FIG. 26 is a layout drawing of the parts when the control circuit part shown in FIG. 25 is viewed from the side.

In the example shown in FIGS. 25 and 26, the control circuit part 114 is provided with a heat radiating plate 176. The heat generating electronic devices 126 and 128 are disposed at one surface of the heat radiating plate 176, and the heat sink 124 is disposed at the other surface of the heat radiating plate 176. The heat of the electronic devices 126 and 128 is consequently transmitted to the heat sink 124 and the heat radiating plate 176. Fuel is discharged to the heat radiating plate 176 from a pressure regulator, or fuel that has been pumped up by a jet pump is discharged to the heat radiating plate 176, thus cooling the heat radiating plate 176. The amount of contact time and the size of the contact area with the fuel that is discharged are increased by attaching the heat radiating plate 176. As a result, the control circuit part 114 can be cooled efficiently.

Figure 27:
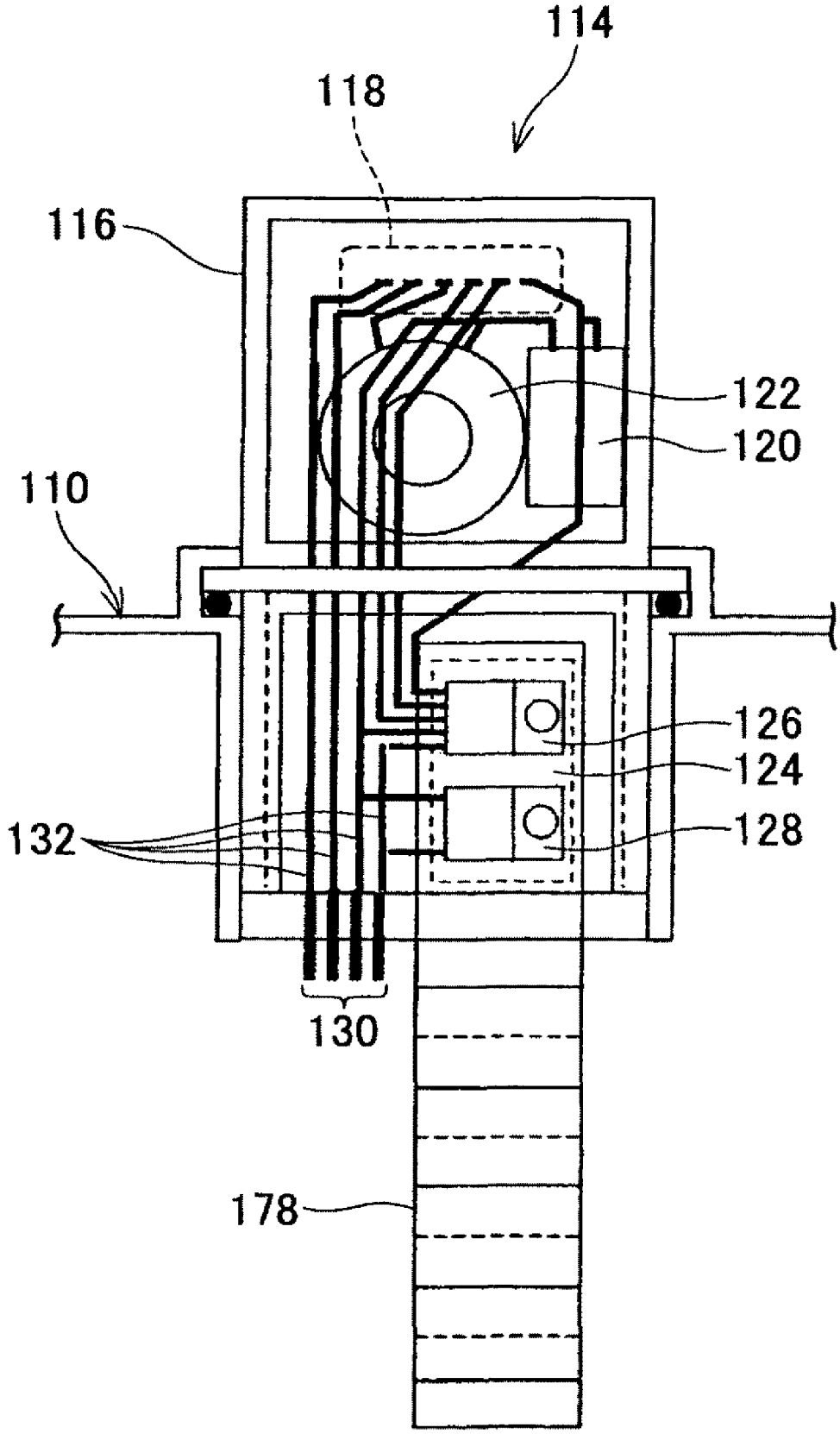
FIG. 27 is a layout drawing schematically showing the layout of parts of a control circuit part of a variant of FIG. 22.
Figure 28:
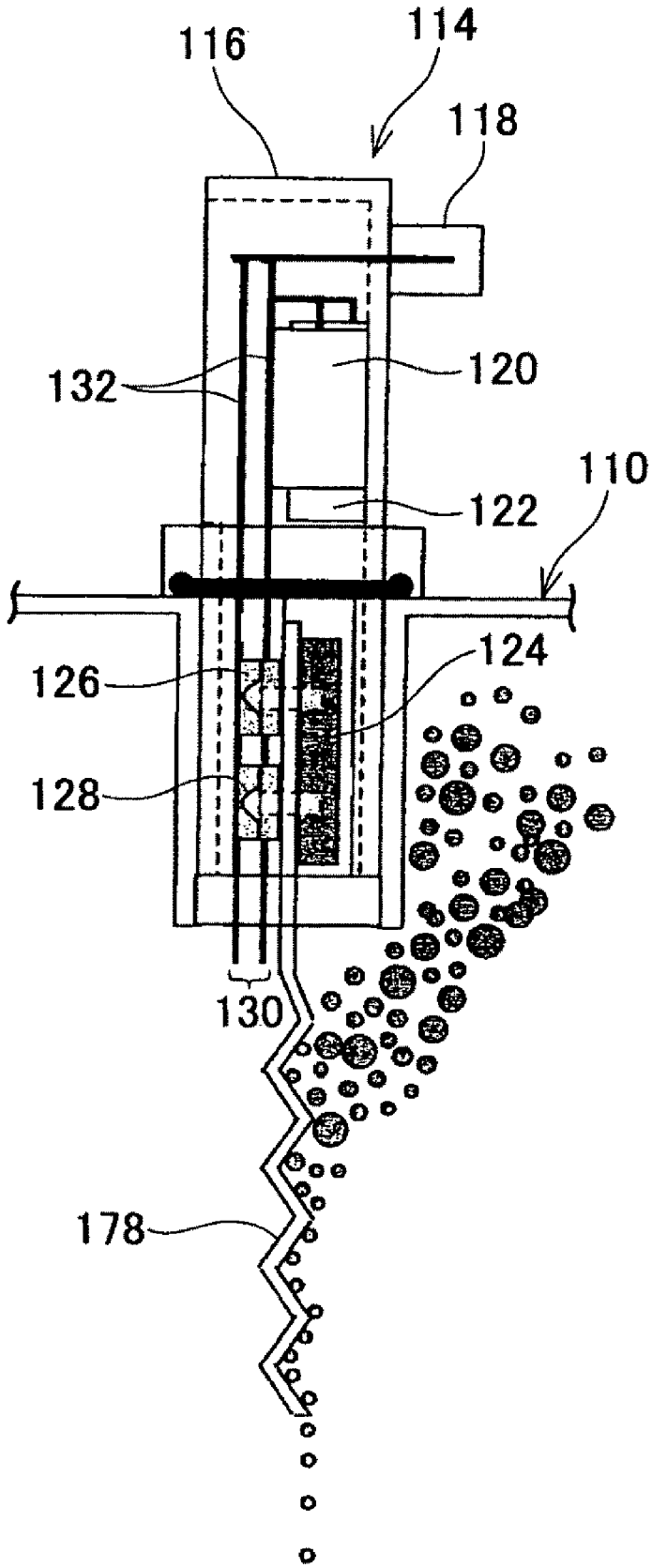
FIG. 28 is a layout drawing of the parts when the control circuit part shown in FIG. 27 is viewed from the side.

In the example shown in FIGS. 27 and 28, a lower end of the heat radiating plate 178 is bent in an accordion shape such that the high parts and the low parts thereof mutually face one another. Surface area can be increased by using this heat radiating plate 178, the amount of contact time when the discharged fuel makes contact with the heat radiating plate 178 is increased, and the cooling capacity is thus improved. Further, the speed at which the fuel descends from the heat radiating plate 178 decreases, consequently allowing the noise while the fuel is descending to be reduced.

Figure 29:
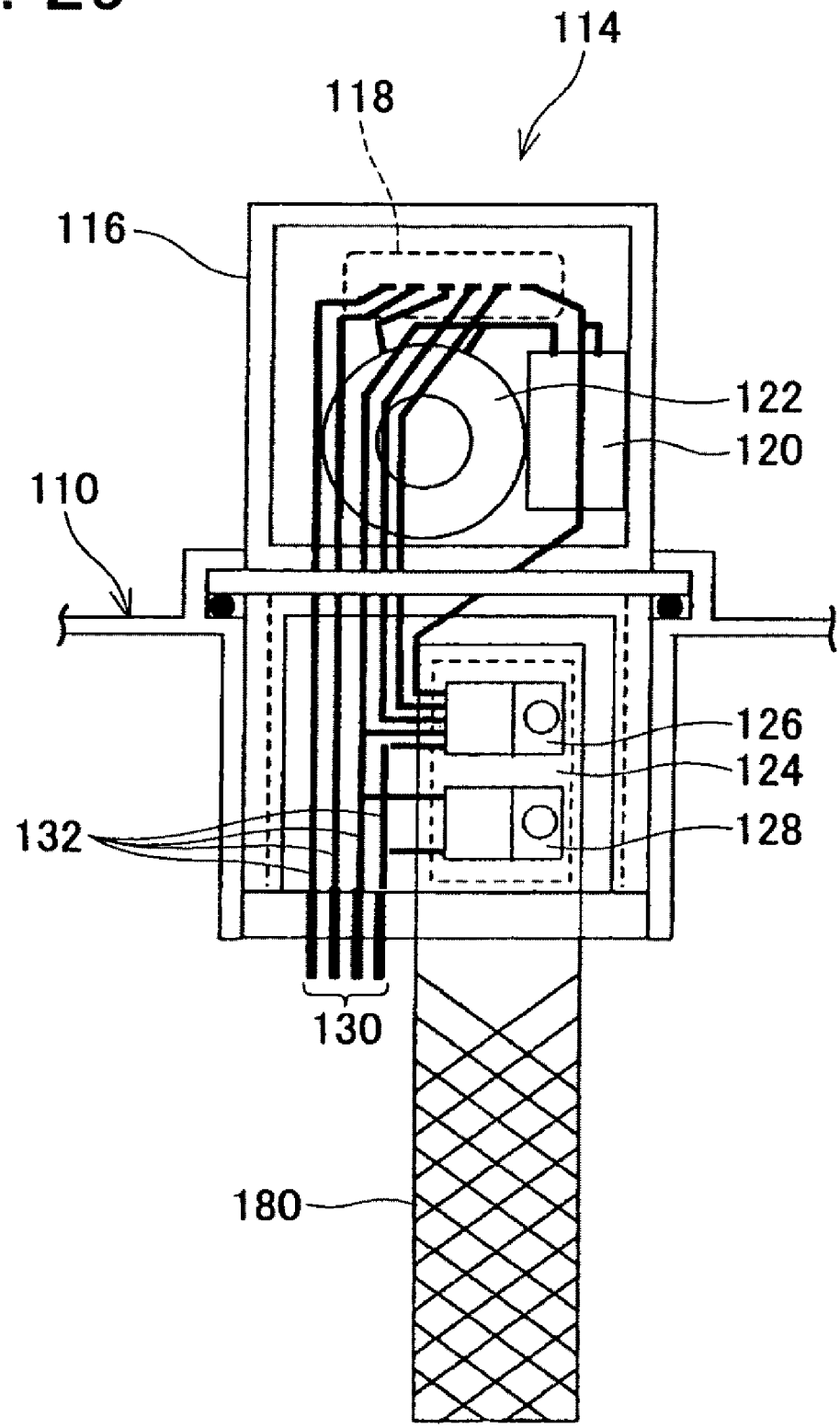
FIG. 29 is a layout drawing schematically showing the layout of parts of a control circuit part of a variant of FIG. 22.
Figure 30:
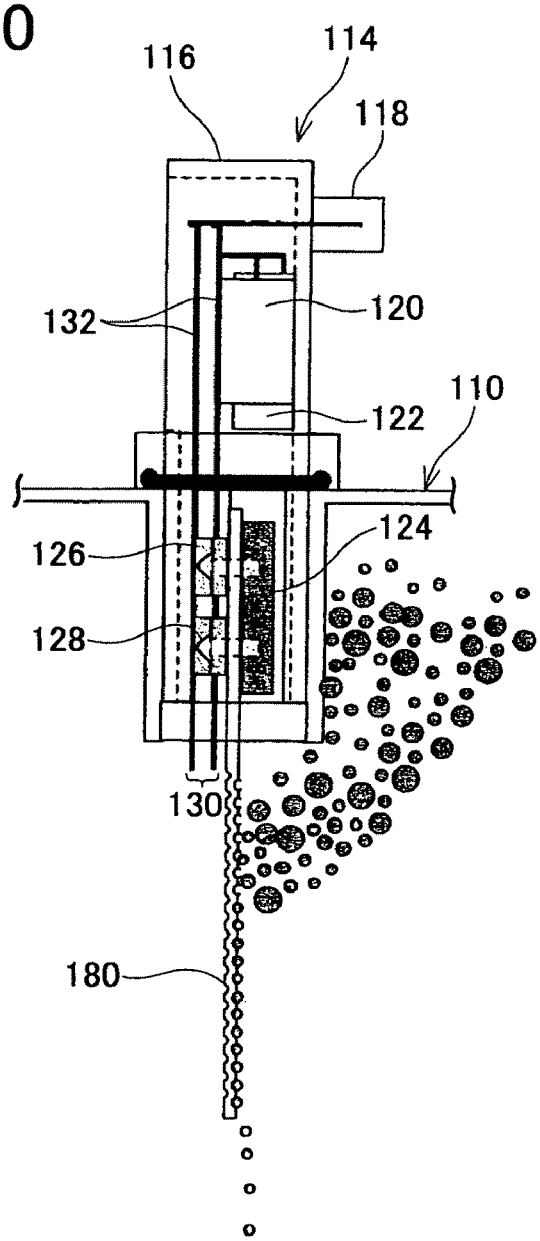
FIG. 30 is a layout drawing of the parts when the control circuit part shown in FIG. 29 is viewed from the side.
Figure 31:
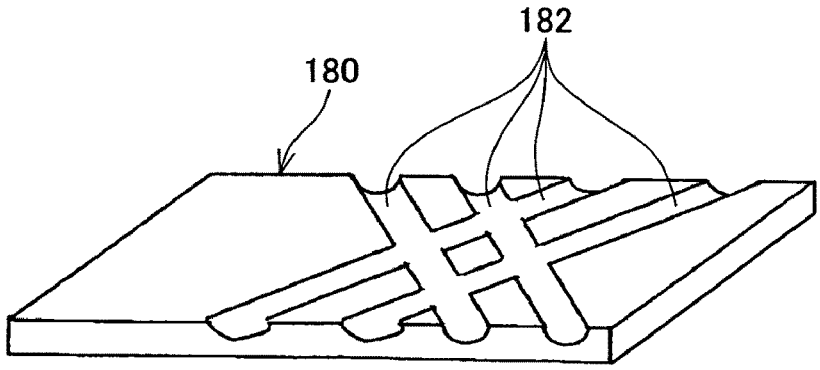
FIG. 31 is an enlarged view of grooves formed in a surface of a heat radiating plate shown in FIGS. 29 and 30.

In the example shown in FIGS. 29, 30, and 31, grooves 182 are formed in a surface of the lower end of the heat radiating plate 178. The amount of contact time when the discharged fuel makes contact with the heat radiating plate 178 is increased by providing the grooves 182 in the surface of the lower end of the heat radiating plate 178, and the cooling capacity is thus improved. Further, the speed at which the fuel descends from the heat radiating plate 178 also decreases, consequently reducing the noise while the fuel is descending.

Figure 32:
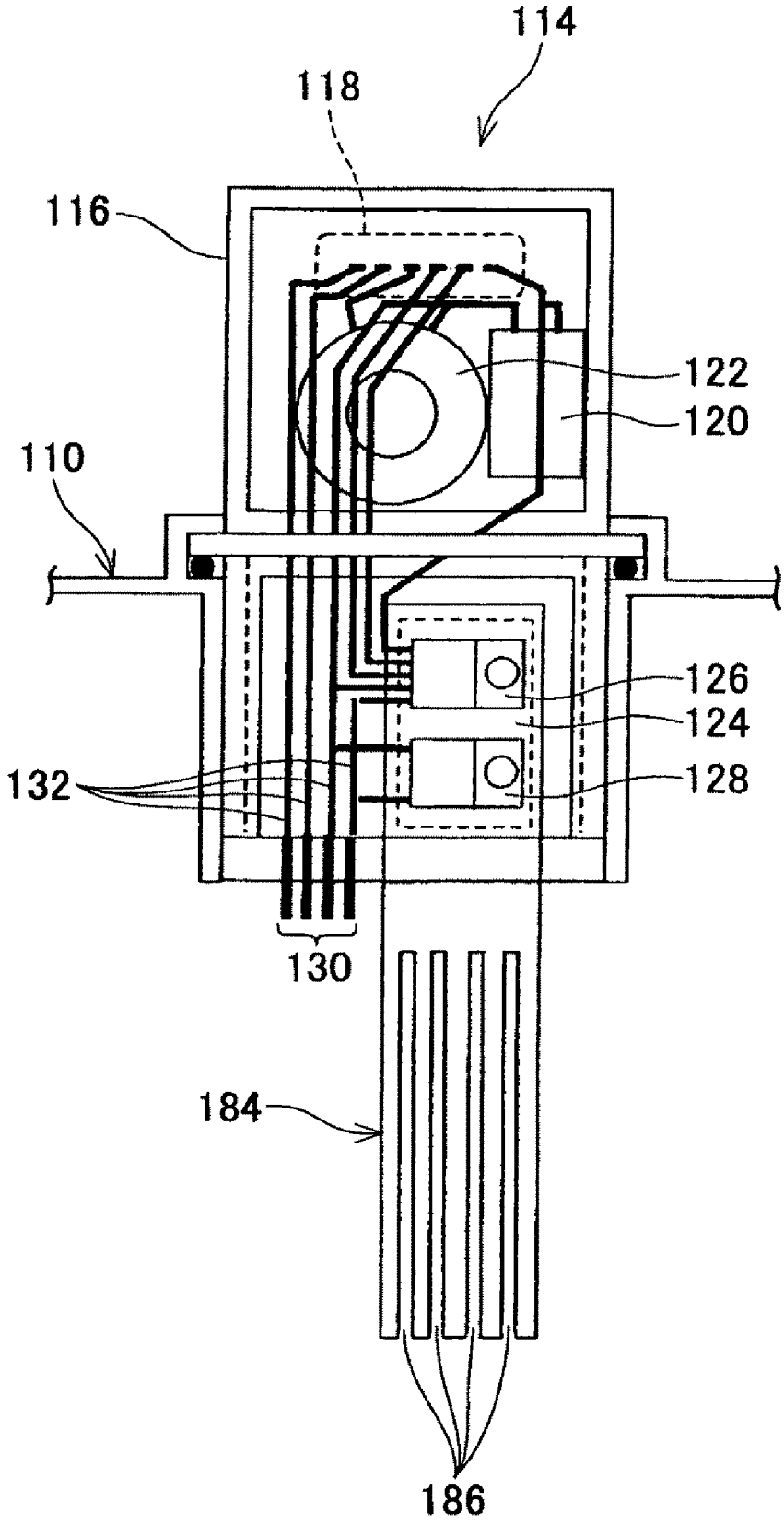
FIG. 32 is a layout drawing schematically showing the layout of parts of a control circuit part of a variant of FIG. 22.
Figure 33:
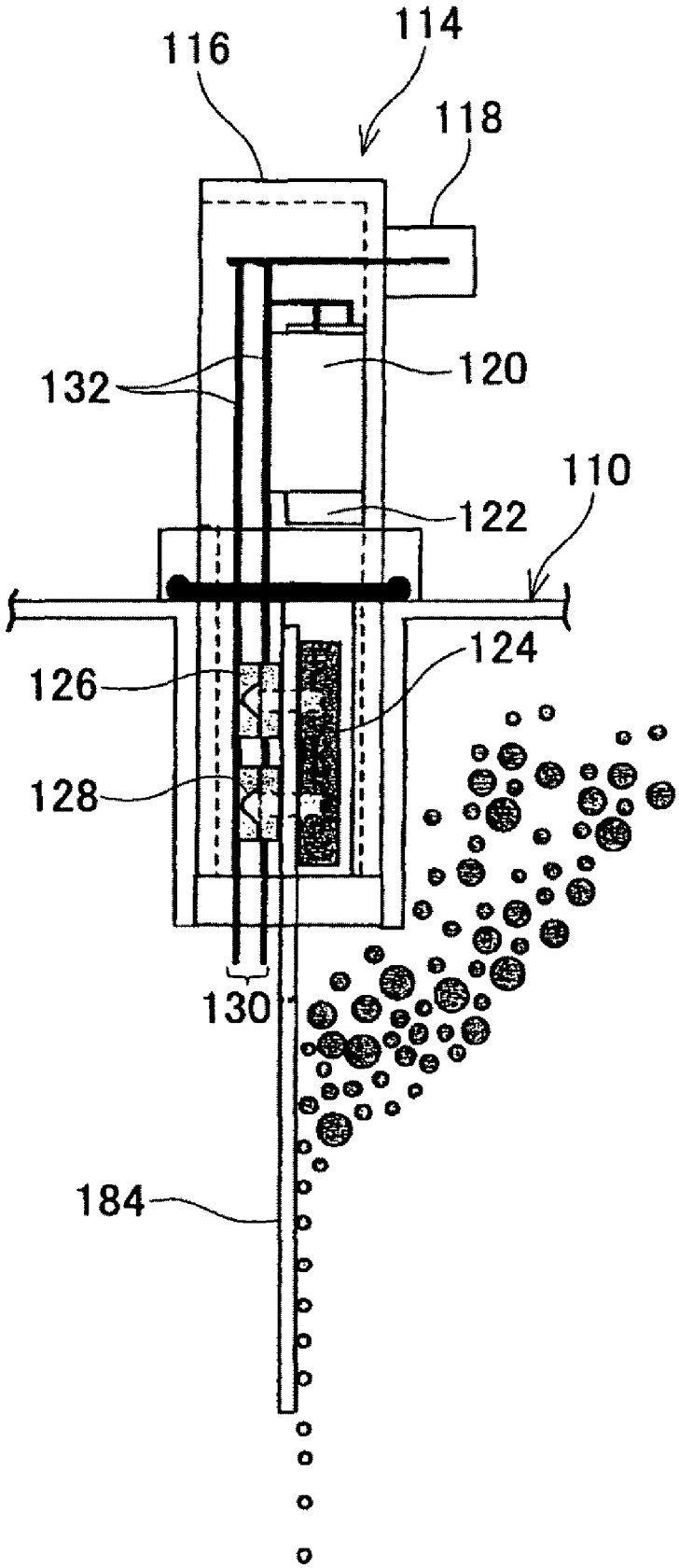
FIG. 33 is a layout drawing of the parts when the control circuit part shown in FIG. 32 is viewed from the side.

In the example shown in FIGS. 32 and 33, grooves 186 are formed in a lower end of a heat radiating plate 186, forming a shape like the teeth of a comb. The surface area of the heat radiating plate 186 can be increased by making the lower end of the heat radiating plate 178 in a comb shape, and the cooling capacity can thus be improved. Further, the fuel that is descending along the heat radiating plate 186 is dispersed by the teeth of the comb, the droplet diameter of the fuel is consequently reduced, as is the noise while the fuel is descending.

Figure 34:
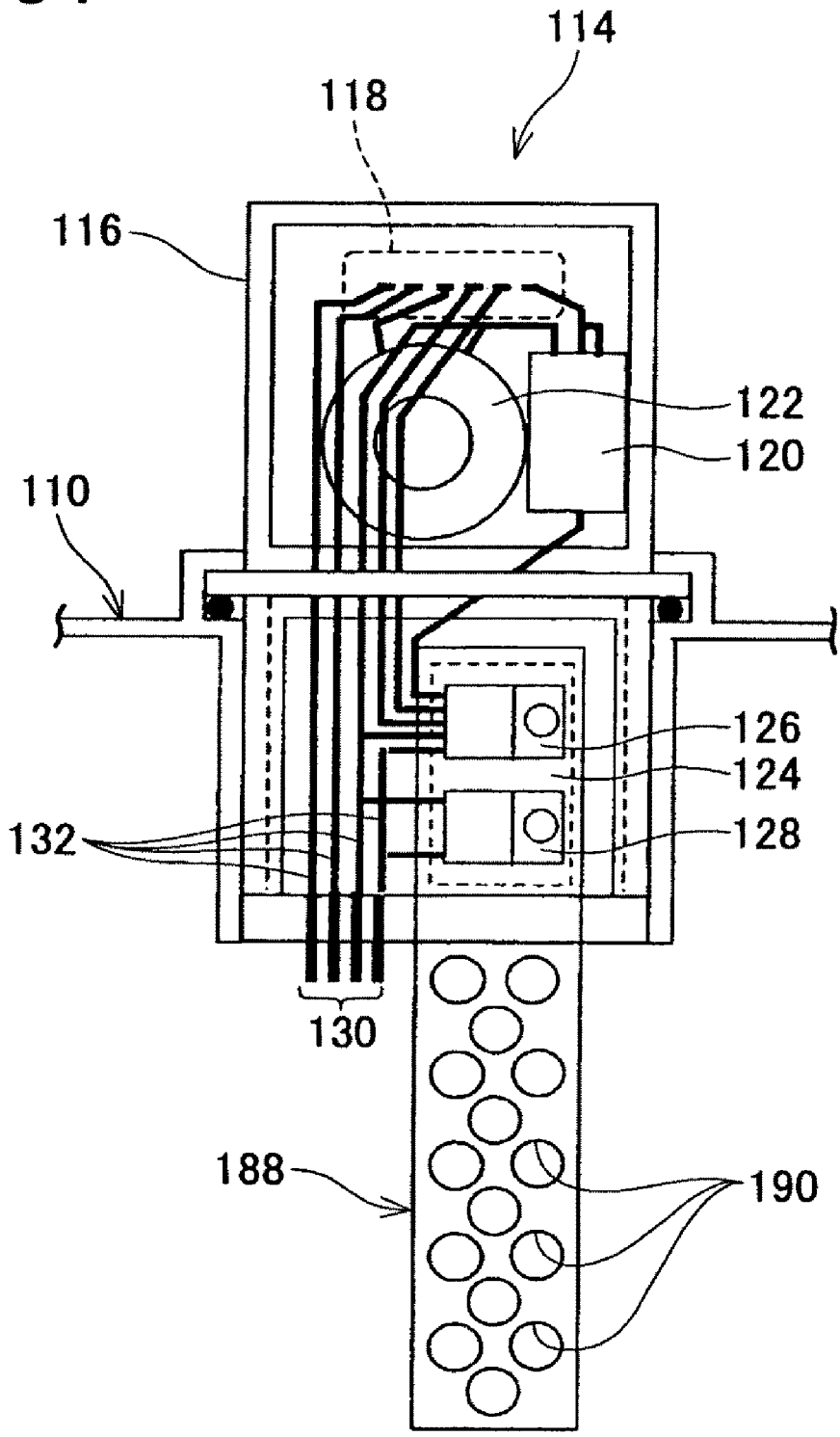
FIG. 34 is a layout drawing schematically showing the layout of parts of a control circuit part of a variant of FIG. 22.
Figure 35:
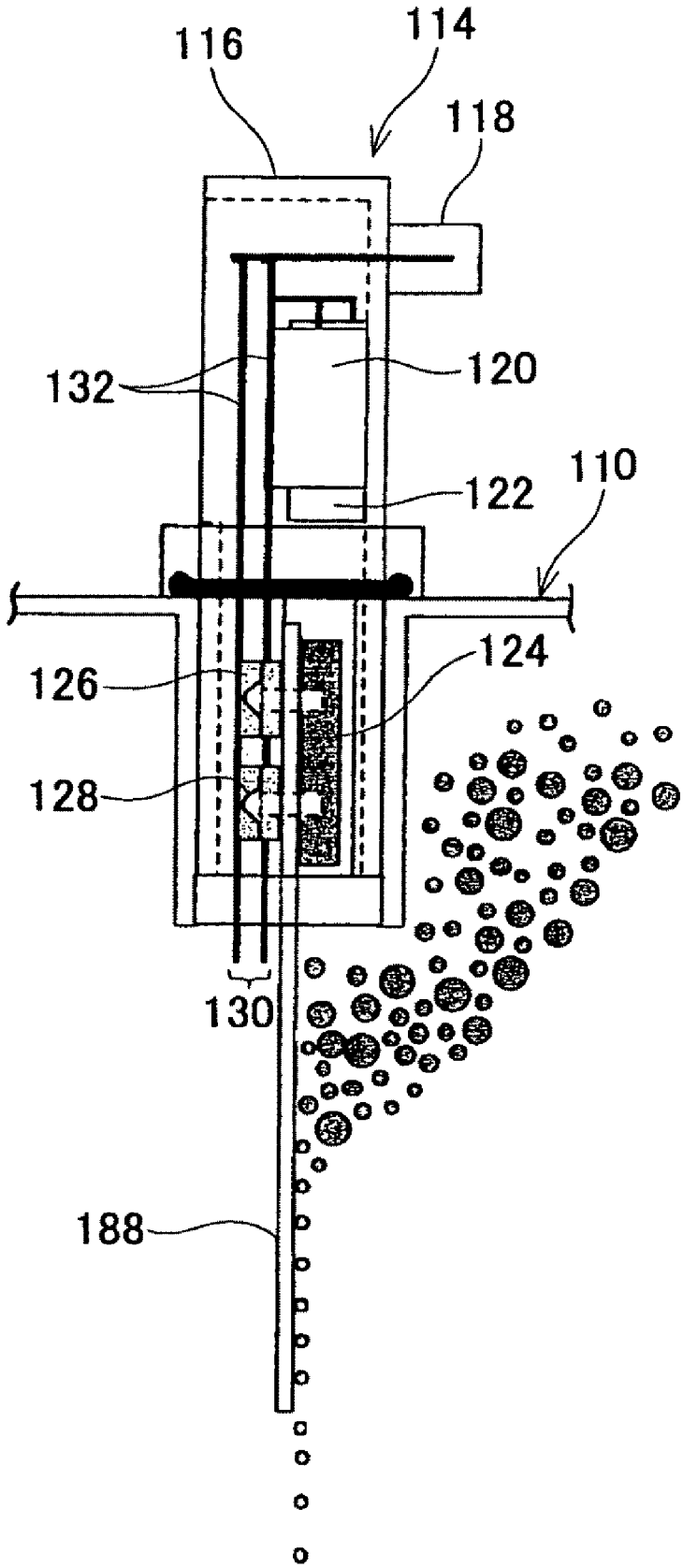
FIG. 35 is a layout drawing of the parts when the control circuit part shown in FIG. 34 is viewed from the side.

In the example shown in FIGS. 34 and 35, circular holes 190 are formed in a lower end of a heat radiating plate 188. The surface area of the heat radiating plate 188 can be increased by forming the circular holes 190 in the lower end of the heat radiating plate 188, and the cooling capacity can thus be improved. Further, the fuel that is descending along the heat radiating plate 188 avoids the circular holes 190 as it descends, the speed at which the fuel descends is consequently reduced, and the noise while the fuel is descending can consequently be reduced.

Figure 36:
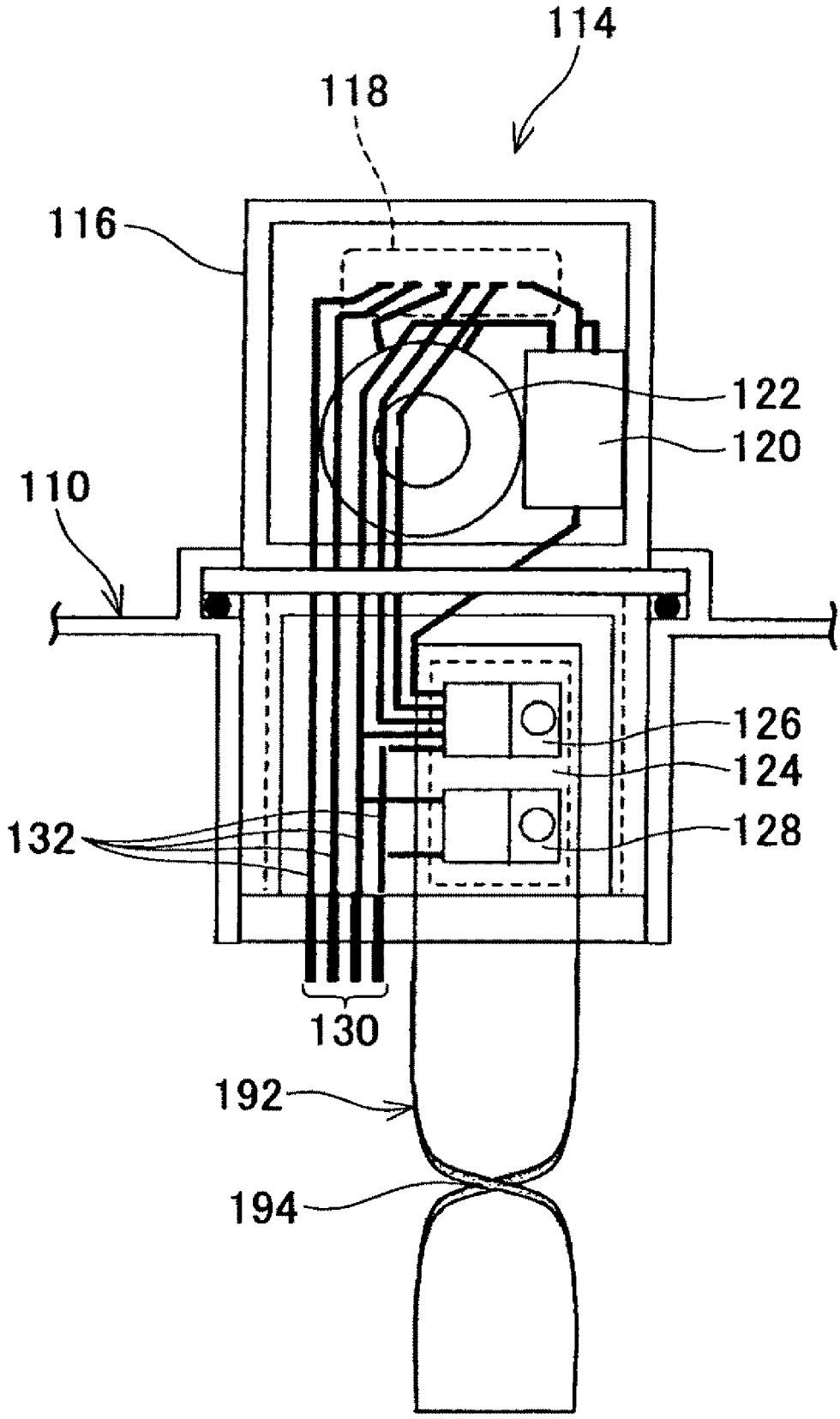
FIG. 36 is a layout drawing schematically showing the layout of parts of a control circuit part of a variant of FIG. 22.
Figure 37:
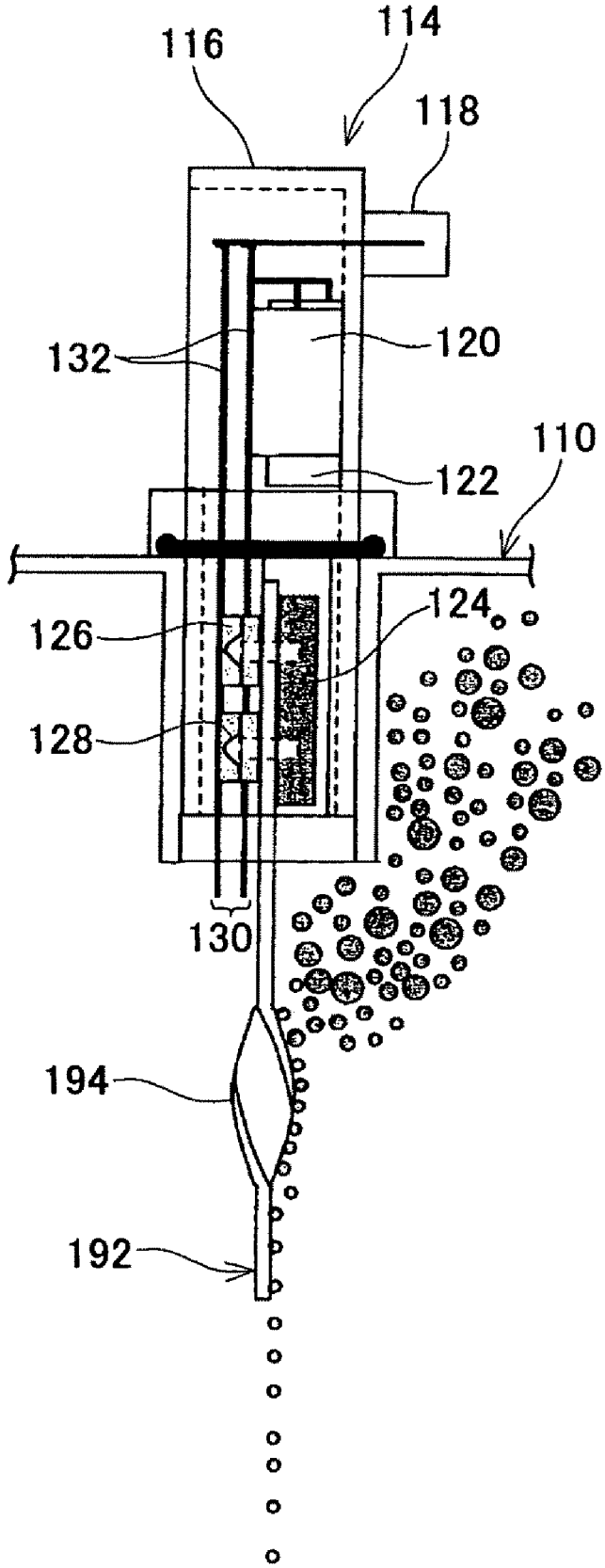
FIG. 37 is a layout drawing of the parts when the control circuit part shown in FIG. 36 is viewed from the side.

In the example shown in FIGS. 36 and 37, a lower end of a heat radiating plate 192 has been twisted. The surface area of the heat radiating plate 192 can be increased without increasing the overall length of the heat radiating plate 192 by twisting the lower end of the heat radiating plate 192. The cooling capacity can thus be improved. Further, the speed of the fuel that is descending along the heat radiating plate 192 is reduced by a twisted part 194 of the heat radiating plate 192, and consequently the noise while the fuel is descending can be reduced.

Figure 38:
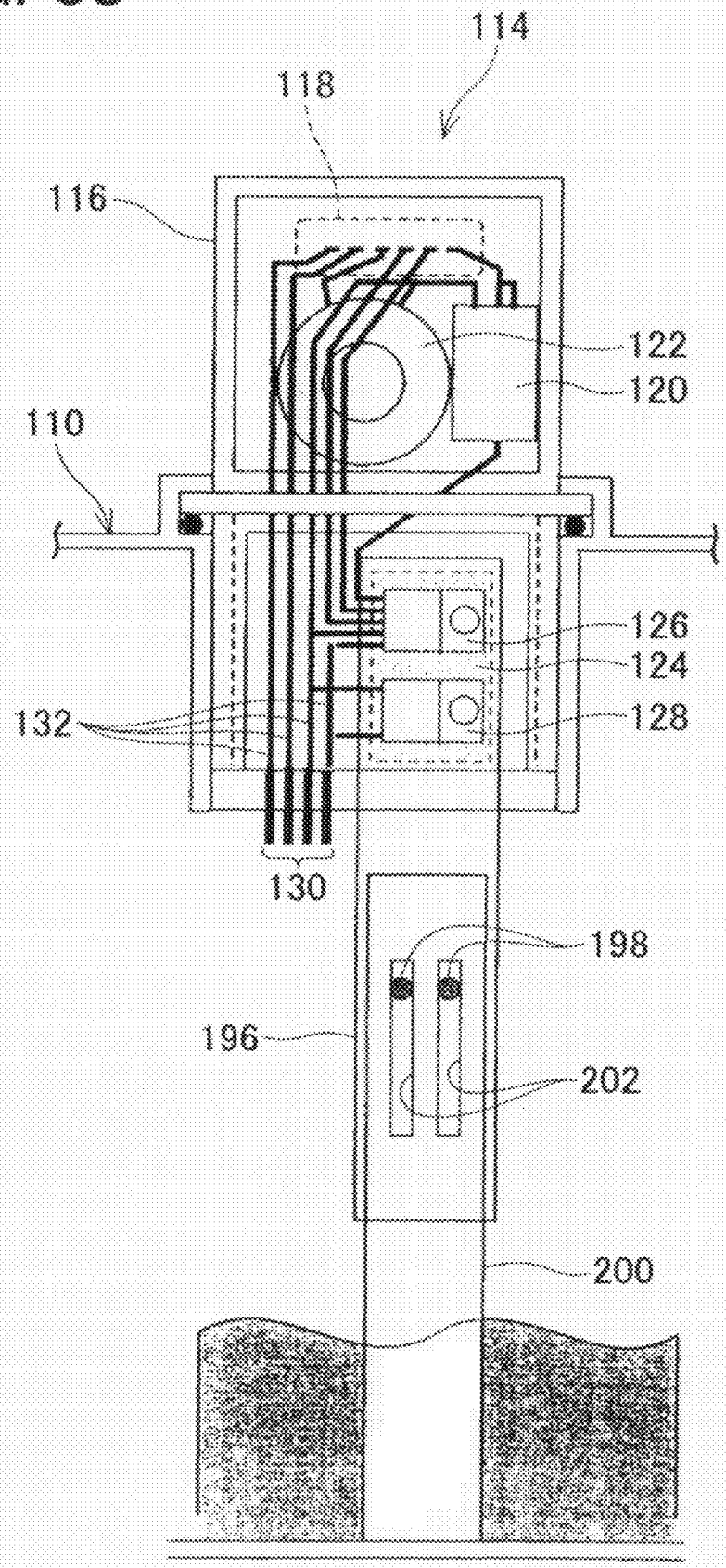
FIG. 38 is a layout drawing schematically showing the layout of parts of a control circuit part of a variant of FIG. 22.
Figure 39:
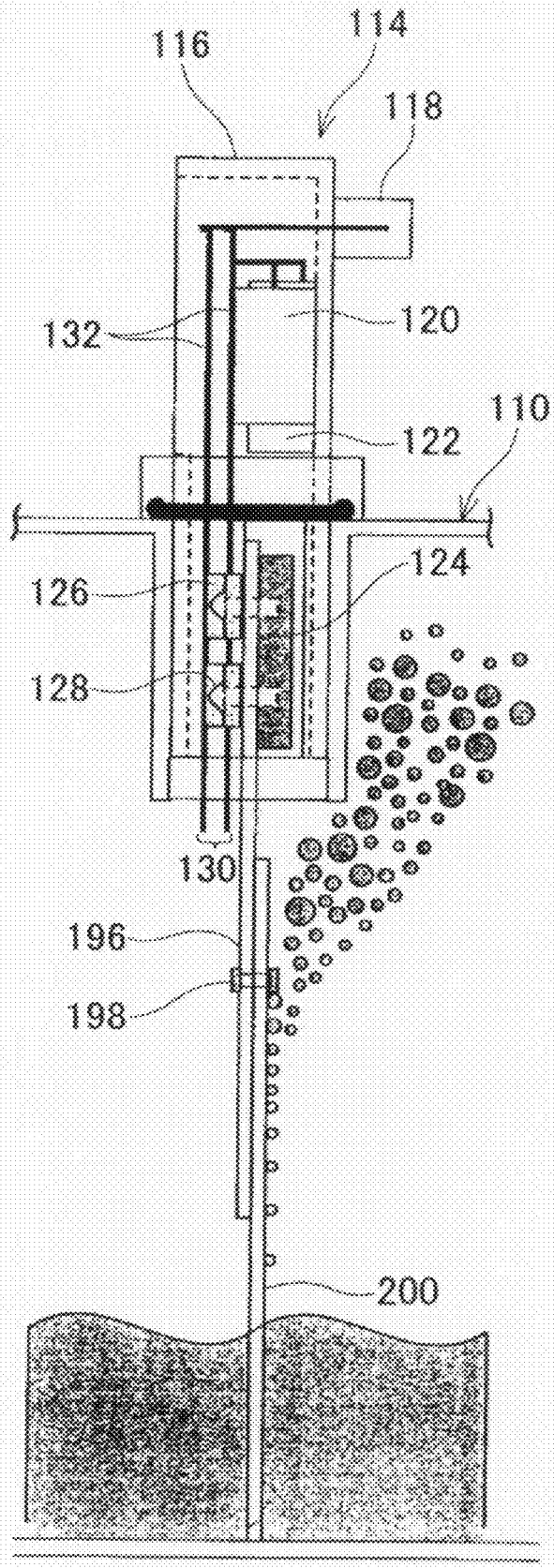
FIG. 39 is a layout drawing of the parts when the control circuit part shown in FIG. 38 is viewed from the side.

Alternatively, the configuration shown in FIGS. 38 and 39 can be adopted. That is, a first heat radiating plate 196 is attached to the control circuit part 114, and a second heat radiating plate 200 is attached to the first heat radiating plate 196 using screws 198. An attachment hole 202 extending in the axial direction is formed in the second heat radiating plate 200, and the position of the second heat radiating plate 200 with respect to the first heat radiating plate 196 can be adjusted. With this type of configuration, a lower end of the second heat radiating plate 200 extends to a bottom surface of the fuel tank, and consequently the lower end of the second heat radiating plate 200 is immersed in the fuel in the fuel tank even if the amount of fuel significantly reduces. The ability of the heat radiating plates 196 and 200 to radiate heat can thus be increased. Further, since the lower end of the second heat radiating plate 200 is immersed in the fuel, the noise of the fuel descending from the heat radiating plates 196 and 200 can be reduced.

Figure 40:
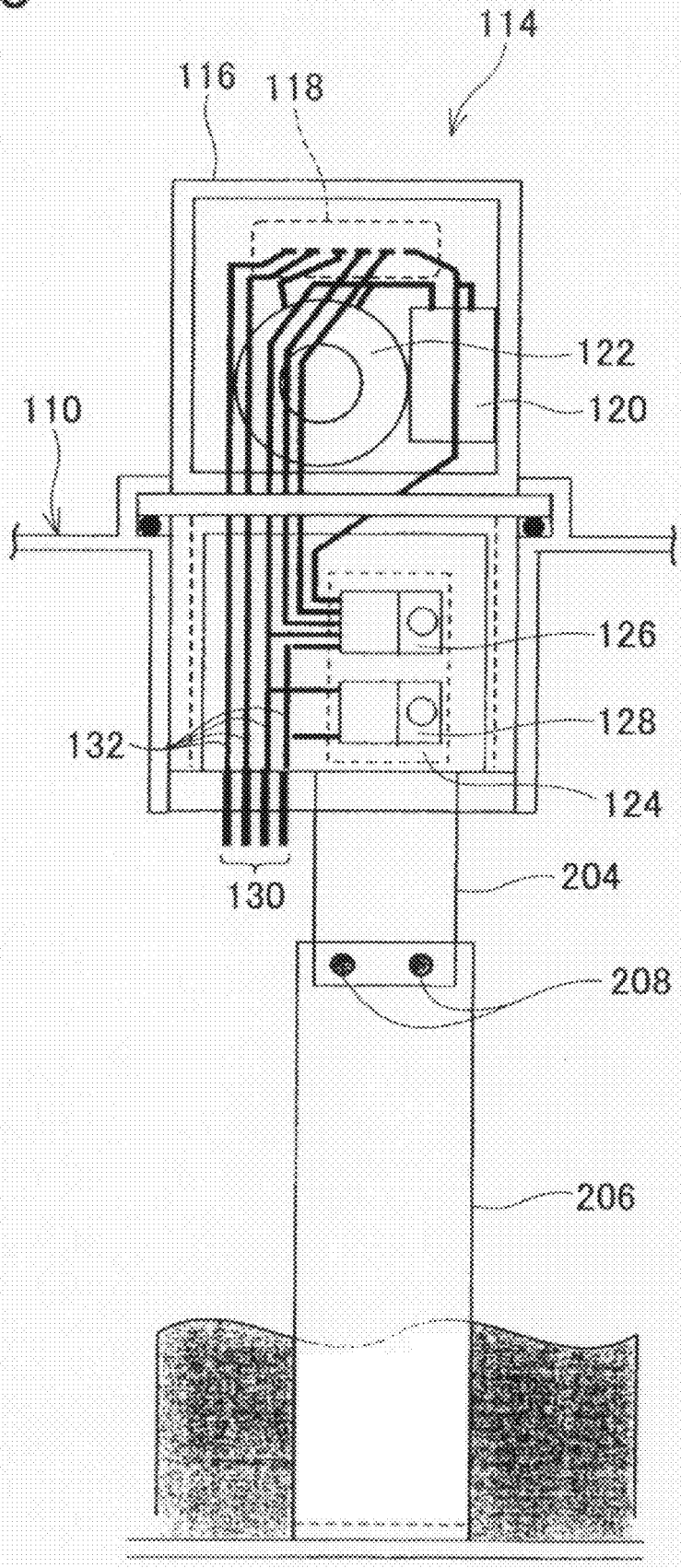
FIG. 40 is a layout drawing schematically showing the layout of parts of a control circuit part of a variant of FIG. 22.
Figure 41:
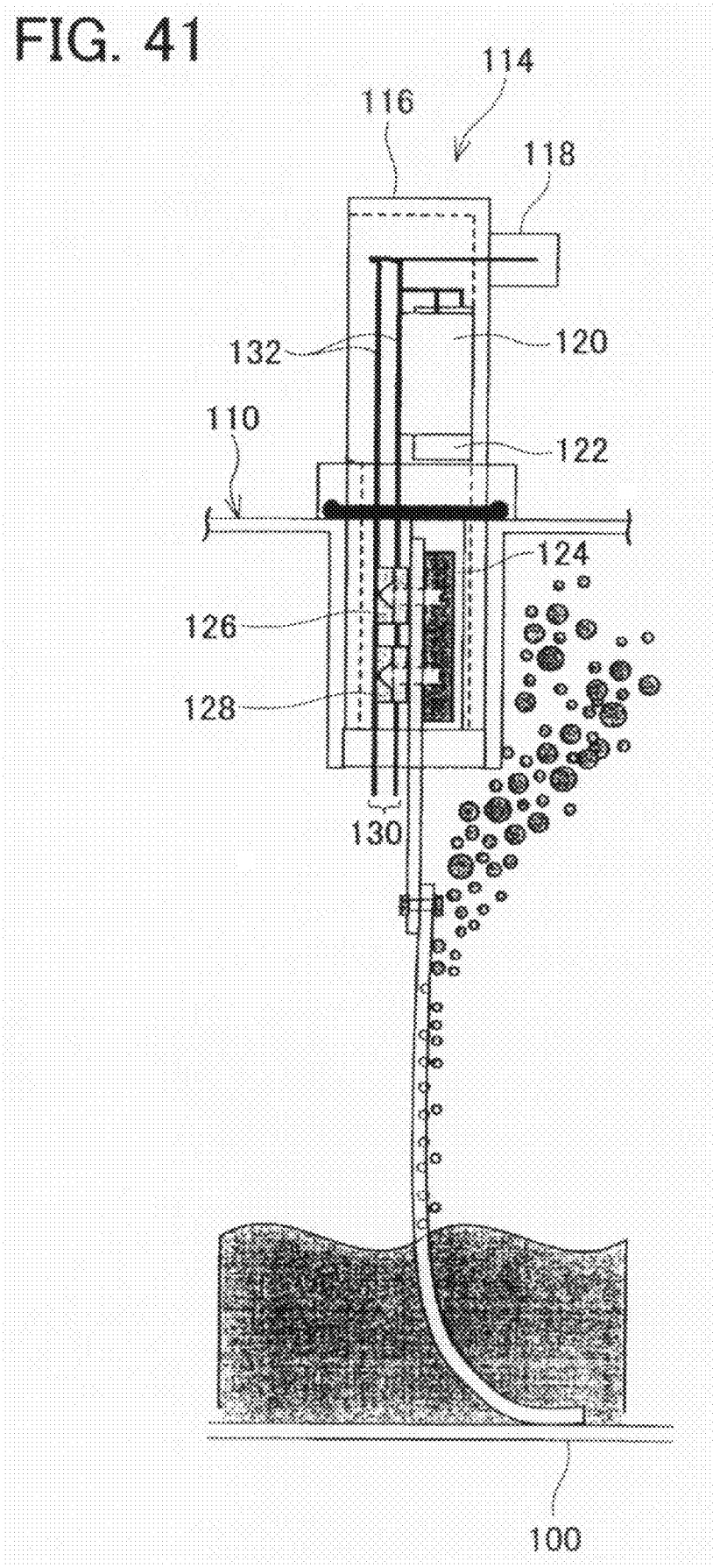
FIG. 41 is a layout drawing of the parts when the control circuit part shown in FIG. 40 is viewed from the side.

Furthermore, as shown in FIGS. 40 and 41, a metal net 206 can be attached to a heat radiating plate 204 using screws 208. Since the metal net 206 is flexible it can make contact in a bent state with the bottom surface of the fuel tank. As a result, the net 206 having the same length can be used even if the fuel tank attached to the fuel supply device is changed and the distance of the fuel tank changes between the upper surface (i.e. the surface attached to the set plate) and the bottom surface. Further, since the metal net 206 is immersed in the fuel in the fuel tank, the ability to radiate heat of the heat radiating plate 204 is increased. In addition, since the fuel descends along the metal net 206, the noise of the descending fuel can be reduced.

Figure 42:
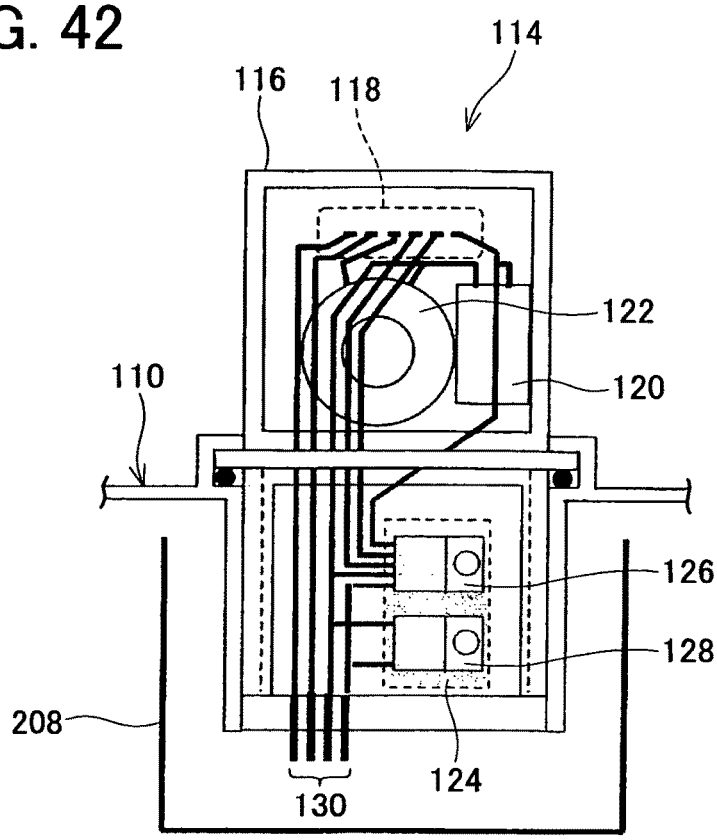
FIG. 42 is a layout drawing schematically showing the layout of parts of a control circuit part of a variant of FIG. 22.
Figure 43:
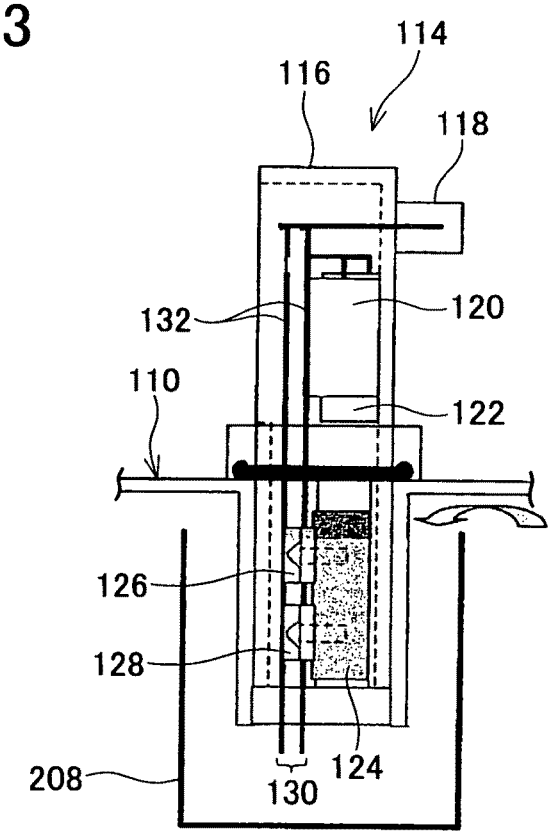
FIG. 43 is a layout drawing of the parts when the control circuit part shown in FIG. 42 is viewed from the side.
Figure 44:
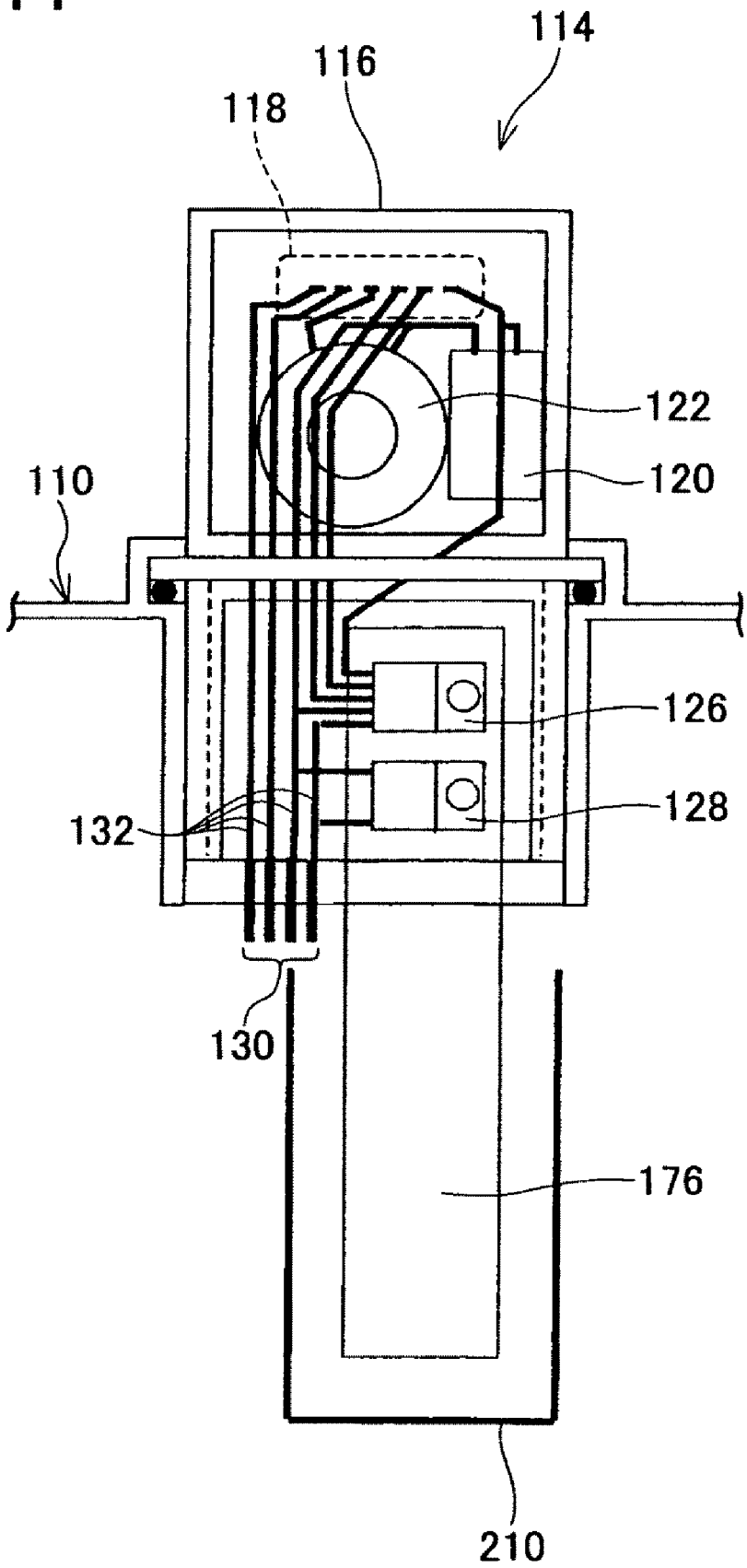
FIG. 44 is a layout drawing schematically showing the layout of parts of a control circuit part of a variant of FIG. 25.
Figure 45:
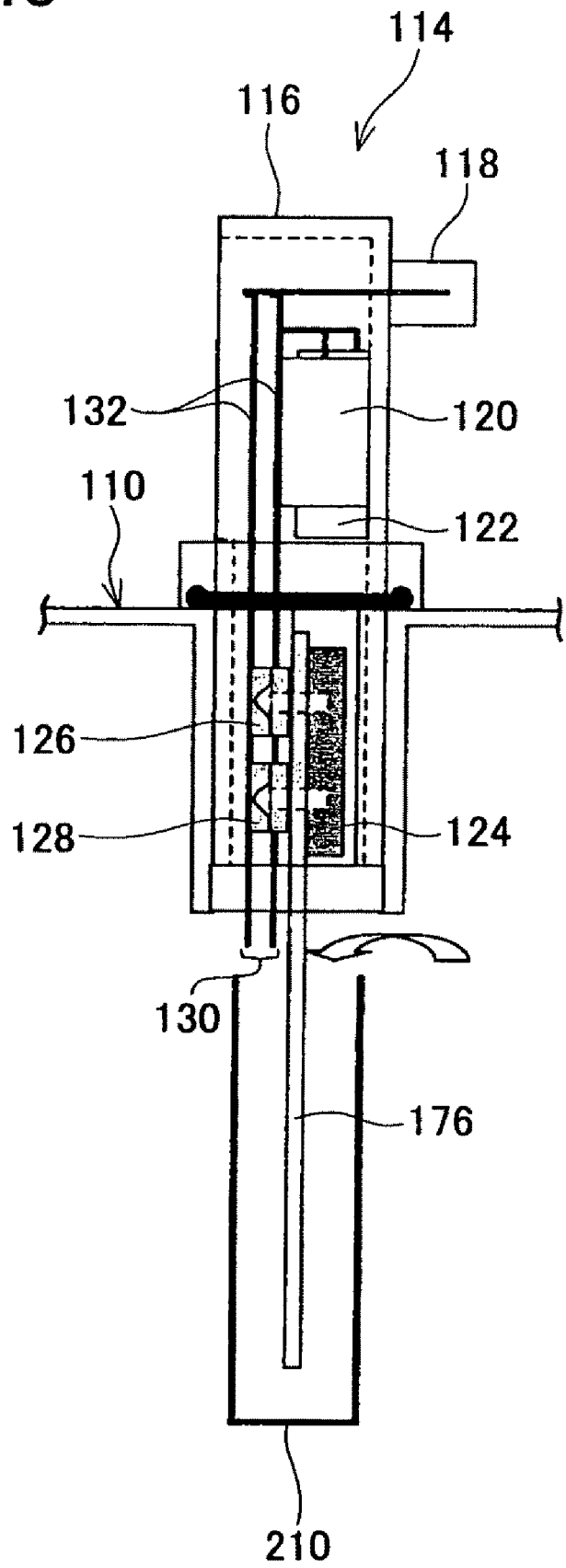
FIG. 45 is a layout drawing of the parts when the control circuit part shown in FIG. 44 is viewed from the side.

In the embodiments described above, the fuel is discharged from a pressure regulator or a jet pump and cools the control circuit part 114. However, the present invention is not limited to this configuration. For example, a storage vessel for storing the fuel discharged from the pressure regulator or the jet pump may be disposed within the fuel tank, and the control circuit part may be cooled by the fuel stored within the storage vessel. For example, in the example shown in FIGS. 42 and 43, a lower part of the control circuit part 114 is disposed within a storage vessel 208, and the control circuit part 114 is immersed directly in the fuel in the storage vessel 208. In this type of example the control circuit part 114 is constantly immersed in the fuel, and consequently the control circuit part 114 can be cooled adequately. Alternatively, as shown in FIGS. 44 and 45, the heat radiating plate 176 may be disposed within a storage vessel 210, and the heat radiating plate 176 may be constantly immersed in the fuel in the storage vessel 210.

Figure 46:
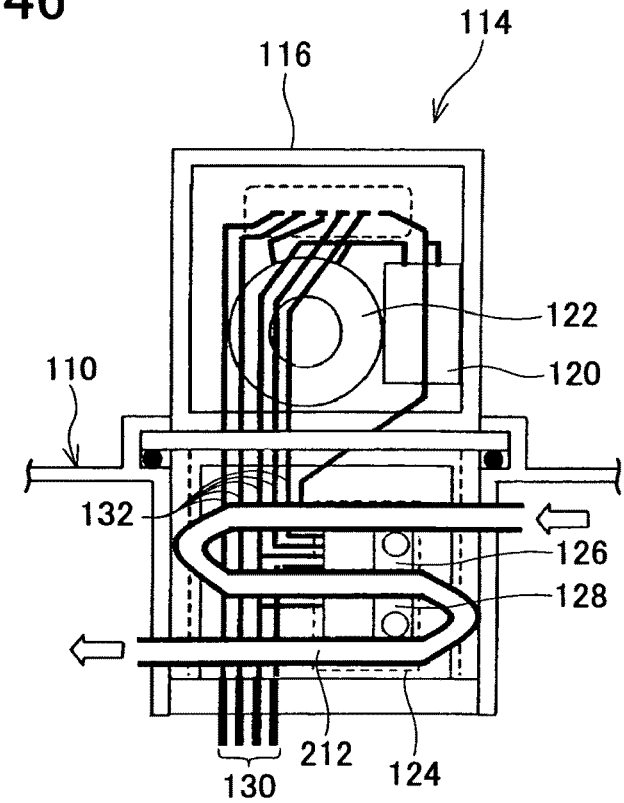
FIG. 46 is a layout drawing schematically showing the layout of parts of a control circuit part of a variant of FIG. 22.
Figure 47:
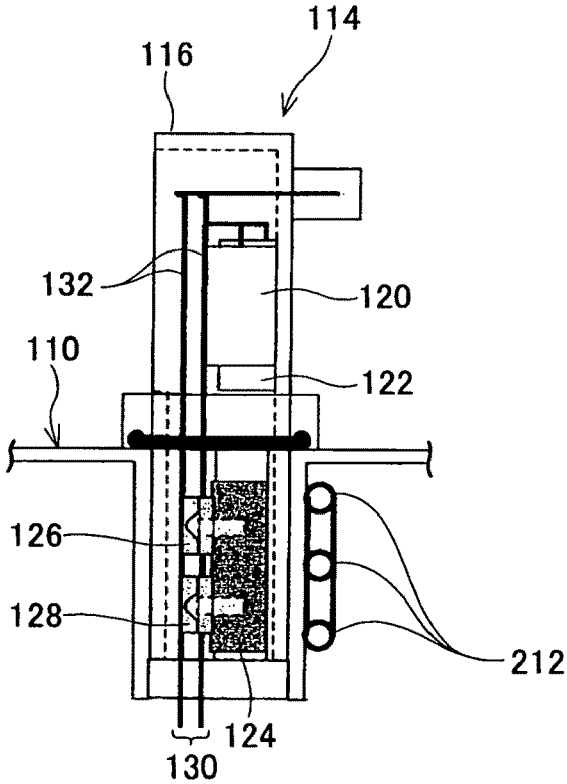
FIG. 47 is a layout drawing of the parts when the control circuit part shown in FIG. 46 is viewed from the side.
Figure 48:
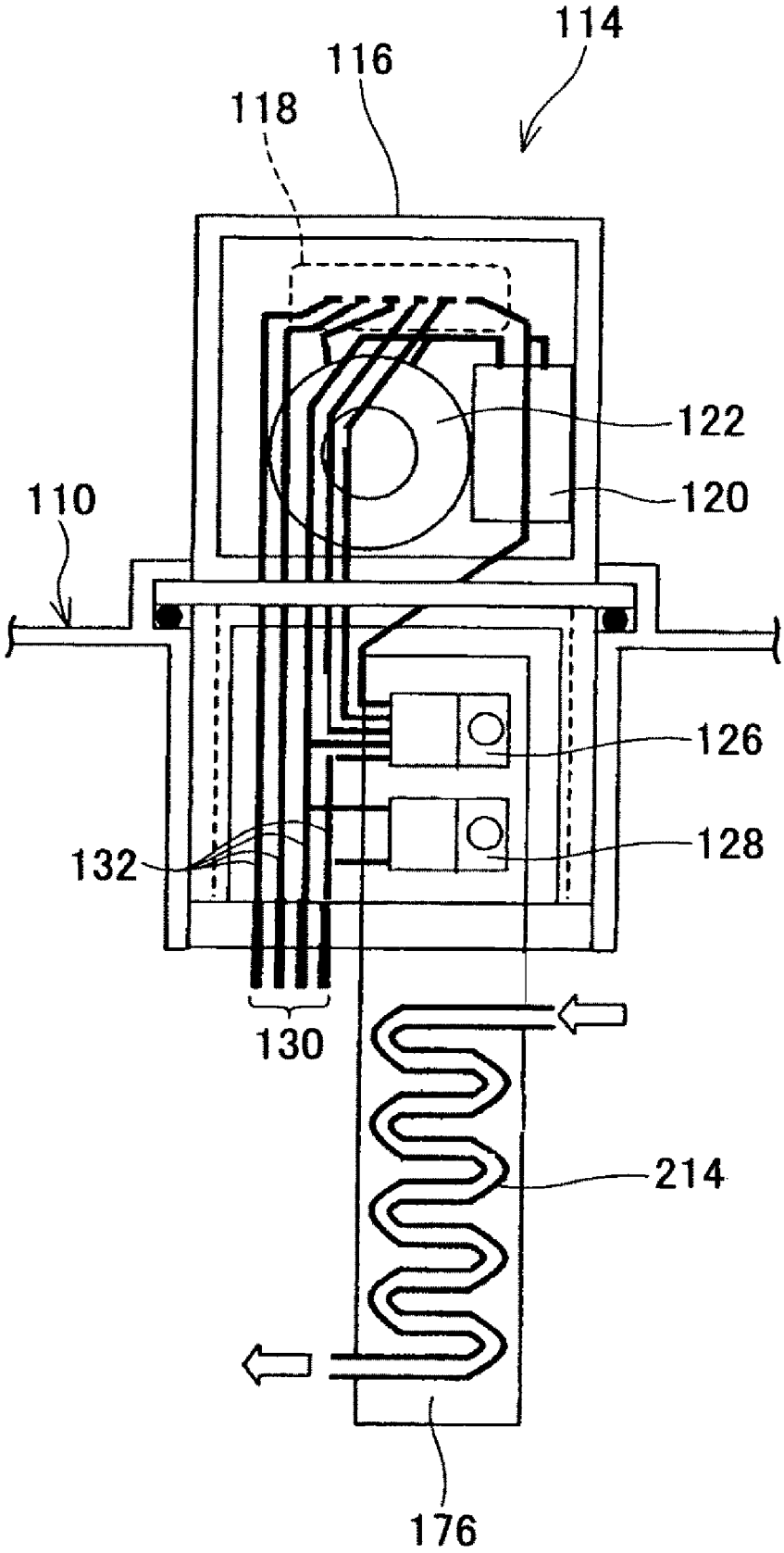
FIG. 48 is a layout drawing schematically showing the layout of parts of a control circuit part of a variant of FIG. 25.
Figure 49:
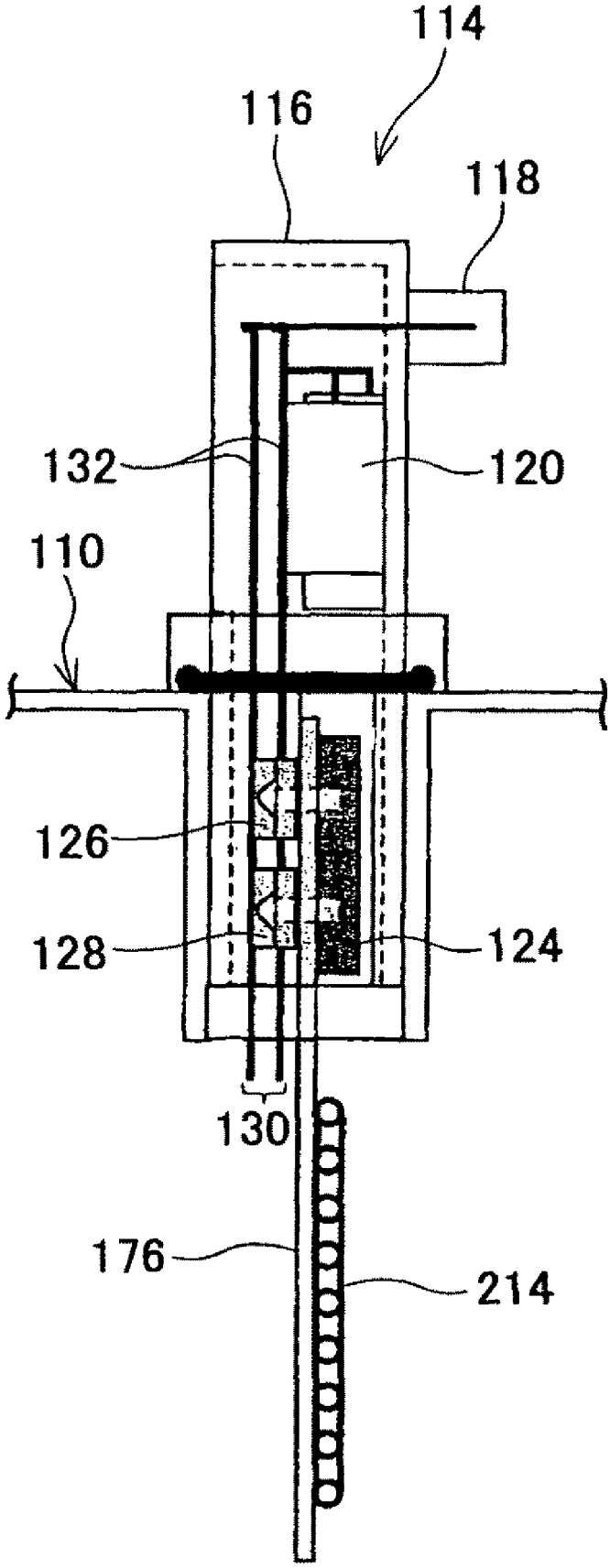
FIG. 49 is a layout drawing of the parts when the control circuit part shown in FIG. 48 is viewed from the side.

Further, the control circuit part and the fuel piping along which the fuel from the pressure regulator or the jet pump flows may be caused to make contact, thus cooling the control circuit part. In the example shown in FIGS. 46 and 47, fuel piping 212 is formed on a surface of the circuit case 116, and heat exchange occurs between the circuit case 116 and the fuel flowing along the fuel piping 212. Alternatively, in the example shown in FIGS. 48 and 49, fuel piping 214 is formed on a surface of the heat radiating plate 176, and heat exchange occurs between the fuel flowing along the fuel piping 214 and the heat radiating plate 176.

In the embodiments described above, the fuel circulating within the fuel tank is discharged to the circuit case, etc. so as to cool the control module. However, the present invention is not restricted to this configuration. Fuel that is surplus to the fuel fed to the exterior of the fuel tank (so-called returning fuel that goes back into the fuel tank) may be discharged to the circuit case to perform cooling.

Several preferred embodiments of the present invention have been described above in detail, however, these embodiments are only examples and do not limit the scope of the claims. Various alternatives and modifications to the above specific examples are included in the technology described in the scope of the patent claims.

Furthermore, the technical elements disclosed in the present specification or figures have technical utility separately or in all types of conjunctions and are not limited to the conjunctions set forth in the claims at the time of filing. Moreover, the art disclosed in the present specification or the drawings achieve a plurality of objects simultaneously, and have technical utility by achieving one of those objects.

The invention claimed is:

1. A fuel supply device for discharging fuel stored within a fuel tank to an exterior of the fuel tank, comprising:

a set plate attached to a mounting hole of a fuel tank, the set plate covering the mounting hole;

an electric fuel pump attached to the inner surface of the set plate;

a control module attached to the outer surface of the set plate, the control module driving the fuel pump using electric power supplied from the exterior of the fuel tank; and a heat radiating member for radiating heat generated in the control module;

wherein one end of the heat radiating member is thermally connected to the control module, and the other end of the heat radiating member protrudes downward from the inner surface of the set plate into the fuel tank, and at least part of the heat radiating member is constructed and arranged to be immersed in the fuel in the fuel tank in order to radiate the heat to the entirety of the fuel in the fuel tank.

2. A fuel supply device according to claim 1, wherein:

the control module comprises a heat generating electronic device;

the heat radiating member is a heat radiating plate formed in a plate shape, and a central part thereof is bent; and one side of the heat radiating plate from the bent part protrudes downward from the inner surface of the set plate, and the heat generating electronic device of the control module is disposed on a surface of the other side of the heat radiating plate from the bent part.

3. A fuel supply device according to claim 1, wherein:

the control module comprises a heat generating electronic device;

the heat radiating member is a cooling rod formed in a rod shape, a plate-shaped head part being formed on the cooling rod; and a part of the cooling rod below the head part protrudes downward from the inner surface of the set plate, and the heat generating electronic device of the control module is disposed on the head part of the cooling rod.

4. A fuel supply device according to claim 1, wherein:

a fuel filter for removing foreign matter from the fuel discharged from the fuel pump is attached to the inner surface of the set plate; and when a circle having the smallest radius capable of housing the fuel pump and the fuel filter has been drawn on a surface perpendicular to an axis of the fuel pump, a part of the heat radiating member protruding from the inner surface of the set plate is disposed within that circle.

5. A fuel supply device according to claim 2, wherein the set plate and the heat radiating plate are molded integrally by insert molding, and a part of the heat radiating plate embedded within the set plate has a through hole formed therein, the through hole passing through the heat radiating plate in its direction of thickness.

6. A fuel supply device according to claim 5, wherein the heat radiating plate is molded integrally in an un-bent state with the set plate, and is bent after being molded integrally.

7. A fuel supply device according to claim 1, wherein a pressure regulator for adjusting pressure of the fuel discharged from the fuel pump, and an ejecting part for ejecting to the fuel tank the fuel being returned by the pressure regulator are further provided on the inner surface of the set plate, the position of the ejecting part and the ejecting direction of the returning fuel being adjusted such that the fuel ejected from the ejection part is discharged toward the heat radiating member.

8. A fuel supply device according to claim 1, further comprising a fuel circulating means for circulating the fuel in the fuel tank around this fuel tank, and a storage vessel for storing the fuel circulated by the fuel circulating means, wherein the heat radiating member is disposed within the storage vessel and a length of the heat radiating member is adjustable.

9. A fuel supply device according to claim 1, further comprising a fuel circulating passage along which the fuel circulating around the fuel tank flows, the heat radiating member and the fuel circulating passage being thermally connected.

10. A fuel supply device for discharging fuel stored within a fuel tank to the exterior of the fuel tank, comprising:

an electric fuel pump;

a set plate attached to a mounting hole of the fuel tank, the set plate covering the mounting hole;

a control module attached to the set plate, the control module driving the fuel pump using electric power supplied from the exterior; and means for circulating fuel in the fuel tank around this fuel tank, wherein:

the fuel circulating means has a fuel discharge hole for discharging the circulating fuel within the fuel tank, and at least a part of the control module is disposed within the fuel tank and is cooled by discharged fuel from the fuel discharge hole.

11. A fuel supply device according to claim 10, further comprising a case for housing the control module, at least a part of the case being exposed within the fuel tank, and the fuel being discharged from the fuel discharge hole at this exposed part.

12. A fuel supply device according to claim 10, further comprising a heat radiating plate thermally connected with the control module, at least a part of the heat radiating plate being exposed within the fuel tank, and the fuel being discharged from the fuel discharge hole at this exposed part.

13. A fuel supply device according to claim 10, wherein the fuel circulating means causes the fuel within the fuel tank to circulate around this fuel tank.

14. A fuel supply device according to claim 10, wherein the fuel circulating means further comprises a relief means for returning surplus fuel, from the fuel pressurized by the fuel pump, back into the fuel tank.

15. A fuel supply device according to claim 10, wherein the fuel circulating means further comprises means for sucking the fuel in the fuel tank using negative pressure generated by utilizing a part of the fuel pressurized by the fuel pump.

16. A device according to claim 11, wherein:

the case is positioned substantially perpendicularly with respect to the set plate, a part of the case protruding into the fuel tank, and a part of the control module being disposed on an inner side of the fuel tank, and a heat generating electronic device of the control module is disposed on the inner side of the fuel tank, and other parts of the control module are disposed on an outer side of the fuel tank.

17. A fuel supply device for discharging fuel stored within a fuel tank to the exterior of the fuel tank, comprising:

a set plate attached to a mounting hole of the fuel tank, the set plate covering the mounting hole;

an electric fuel pump attached to the set plate;

a control module for driving the fuel pump using electric power supplied from the exterior of the fuel tank;

a heat radiating member for radiating heat generated in the control module;

means for circulating fuel in the fuel tank around this fuel tank; and a storage vessel for storing the fuel circulated by the fuel circulating means, wherein the storage vessel is disposed in a position apart from the set plate, and the control module is attached to the set plate and is cooled by the fuel stored in the storage vessel.

18. A fuel supply device for discharging fuel stored within a fuel tank to an exterior of the fuel tank, comprising:

a set plate attached to a mounting hole of a fuel tank, the set plate covering the mounting hole;

an electric fuel pump attached to an inner surface of the set plate;

a control module attached to an outer surface of the set plate, the control module driving the fuel pump using electric power supplied from the exterior of the fuel tank;

a heat radiating member for radiating heat generated in the control module;

a pressure regulator provided on the inner surface of the set plate, the pressure regulator adjusting pressure of the fuel discharged from the fuel pump; and an ejecting part provided on the inner surface of the set plate, the ejecting part ejecting to the fuel tank the fuel being returned by the pressure regulator;

wherein:

one end of the heat radiating member is thermally connected to the control module, and the other end of the heat radiating member protrudes downward from the inner surface of the set plate, and the position of the ejecting part and the ejecting direction of the returning fuel are adjusted such that the fuel ejected from the ejecting part is discharged toward the heat radiating member.

* * * * *